US012679522B2

(12) United States Patent
Ikegaya

(10) Patent No.: US 12,679,522 B2
(45) Date of Patent: Jul. 14, 2026

(54) WATERCRAFT PROPULSION SYSTEM, AND WATERCRAFT

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 448 days.

(21) Appl. No.: 18/381,210

(22) Filed: Oct. 18, 2023

(65) Prior Publication Data

US 2024/0132194 A1 Apr. 25, 2024
US 2024/0228005 A9 Jul. 11, 2024

(30) Foreign Application Priority Data

Oct. 19, 2022 (JP) ..... 2022-167330

(51) Int. Cl.
*B63H 25/42* (2006.01)
*B63H 20/00* (2006.01)
*B63H 20/08* (2006.01)

(52) U.S. Cl.
CPC ..... *B63H 25/42* (2013.01); *B63H 20/08* (2013.01); *B63H 2020/003* (2013.01)

(58) Field of Classification Search
CPC .. B63H 25/42; B63H 20/08; B63H 2020/003; B63H 21/21; B63H 2025/026; B63H 20/007; B63H 21/17; B63H 21/20; B63H 21/213; B63H 25/02; B63H 2021/205
See application file for complete search history.

(56) References Cited

U.S. PATENT DOCUMENTS 7,882,791 B2 2/2011 Huntt
8,700,238 B2 4/2014 Hiramatsu
8,807,059 B1 * 8/2014 Samples ..... B63H 20/20 114/144 R
9,487,283 B2 11/2016 Inoue et al.
2014/0156124 A1 6/2014 Hara et al.
2019/0112021 A1 4/2019 Watanabe et al.

FOREIGN PATENT DOCUMENTS

EP 4309996 A1 * 1/2024 ..... B63H 21/17

OTHER PUBLICATIONS

Official Communication issued in corresponding European Patent Application No. 23202890.2, mailed on Apr. 9, 2024.

* cited by examiner

*Primary Examiner* — Anthony D Wiest
(74) *Attorney, Agent, or Firm* — Keating & Bennett, LLP

(57) ABSTRACT

A watercraft propulsion system includes first and second propulsion devices attachable to a hull asymmetrically with respect to an anteroposterior center line of the hull, a lateral movement command generator to generate a first lateral movement command and a second lateral movement command to laterally move the hull rightward and leftward, and a controller. The controller includes a memory to store first and second lateral movement thrust ratios indicating ratios between a forward propulsive force and a reverse propulsive force in a first lateral movement control and a second lateral movement control. When one of the first and second lateral movement thrust ratios is set in a calibration mode, the controller is configured or programmed to set an initial value of the other of the first and second lateral movement thrust ratios to an inverse of the one of the first and second lateral movement thrust ratios.

8 Claims, 14 Drawing Sheets

WATERCRAFT PROPULSION SYSTEM, AND WATERCRAFT

CROSS REFERENCE TO RELATED APPLICATIONS

This application claims the benefit of priority to Japanese Patent Application No. 2022-167330 filed on Oct. 19, 2022. The entire contents of this application are hereby incorporated herein by reference.

BACKGROUND OF THE INVENTION

1. Field of the Invention

The present invention relates to a watercraft propulsion system, and a watercraft including the watercraft propulsion system.

2. Description of the Related Art

US 2019/0112021 A1 discloses a watercraft which includes a port-side forward-reverse propeller and a starboard-side forward-reverse propeller, two engines that respectively drive the port-side forward-reverse propeller and the starboard-side forward-reverse propeller, two rudders respectively provided rearward of the port-side forward-reverse propeller and the starboard-side forward-reverse propeller, and a side thruster provided at the bow of the watercraft. US 2019/0112021 A1 further discloses that the watercraft is moved and the bow of the watercraft is turned by generating propulsive forces from the forward-reverse propellers and the side thruster according to the operation of a joystick lever. Further, description is provided regarding calibration for lateral movement, calibration for oblique movement, and calibration for bow turning. Particularly, detailed description is provided regarding the calibration for the bow turning.

SUMMARY OF THE INVENTION

The inventor of preferred embodiments of the present invention described and claimed in the present application conducted an extensive study and research regarding a watercraft propulsion system, such as the one described above, and in doing so, discovered and first recognized new unique challenges and previously unrecognized possibilities for improvements as described in greater detail below.

In US 2019/0112021 A1, detailed description of the calibration for the lateral movement is not provided.

The position of the turning center of the watercraft varies depending on the structure of the hull, the arrangement of various watercraft devices, cargo, and the like and, therefore, varies from one watercraft to another. Even if propulsion devices have the same specifications, there are variations in propulsive force to be outputted for the same propulsive force command, and the propulsive forces generated by the propulsion devices do not always act on the hull in the same manner. Therefore, watercraft need to be preliminarily individually calibrated for hull behaviors, particularly for lateral hull movement, i.e., lateral translation movement without bow turning. The lateral movement is available when two or more propulsion devices are provided on the hull. Specifically, the lateral movement can be achieved by causing the resultant vector of propulsive forces generated by two propulsion devices to act along an action line extending laterally of the hull through the turning center of the hull. The position of the turning center is unknown. Therefore, an operation element such as a joystick is actually operated so as to move the hull laterally, and the control states (operation states) of the propulsion devices observed at this time are stored in a memory. Thus, calibration is achieved. Since rightward lateral movement and leftward lateral movement are performed under different operation conditions, it is basically necessary to perform the lateral movement calibration separately for the rightward lateral movement and for the leftward lateral movement.

Preferred embodiments of the present invention provide watercraft propulsion systems that are each able to easily perform calibration for lateral movement, and watercraft including the watercraft propulsion systems.

Further preferred embodiments of the present invention provide watercraft propulsion systems that are each able to achieve a proper hull behavior in lateral movement, and watercraft including the watercraft propulsion systems.

In order to overcome the previously unrecognized and unsolved challenges described above, a preferred embodiment of the present invention provides a watercraft propulsion system including a first propulsion device attachable to a hull, a second propulsion device attachable to the hull asymmetrically to the first propulsion device with respect to an anteroposterior center line of the hull, a lateral movement command generator to generate a first lateral movement command to laterally move the hull in one of a rightward direction and a leftward direction, and to generate a second lateral movement command to laterally move the hull in the other of the rightward direction and the leftward direction, and a controller. The controller is configured or programmed to perform a first lateral movement control in response to the first lateral movement command to cause one of the first propulsion device and the second propulsion device to generate a reverse propulsive force and cause the other of the first propulsion device and the second propulsion device to generate a forward propulsive force, and to perform a second lateral movement control in response to the second lateral movement command to cause the one of the first propulsion device and the second propulsion device to generate a forward propulsive force and cause the other of the first propulsion device and the second propulsion device to generate a reverse propulsive force. The controller includes a memory to store a first lateral movement thrust ratio indicating a ratio between the forward propulsive force and the reverse propulsive force in the first lateral movement control and a second lateral movement thrust ratio indicating a ratio between the forward propulsive force and the reverse propulsive force in the second lateral movement control. The controller is configured or programmed to set the forward propulsive force and the reverse propulsive force to be generated in the first lateral movement control according to the first lateral movement thrust ratio stored in the memory, and to set the forward propulsive force and the reverse propulsive force to be generated in the second lateral movement control according to the second lateral movement thrust ratio stored in the memory. The controller is configured or programmed to set the first lateral movement thrust ratio and the second lateral movement thrust ratio in a calibration mode and, when one of the first lateral movement thrust ratio and the second lateral movement thrust ratio is set in the calibration mode, to set an initial value of the other of the first lateral movement thrust ratio and the second lateral movement thrust ratio to the inverse of the one lateral movement thrust ratio.

With this arrangement, when a lateral movement thrust ratio for lateral movement in one of opposite lateral directions is set in the calibration mode, the initial value of a lateral movement thrust ratio for lateral movement in the other lateral direction is properly set. This makes it easier to perform calibration for the lateral movement in the other lateral direction. Thus, the calibration for lateral movement is facilitated.

The first propulsion device and the second propulsion device are attachable to the hull asymmetrically with respect to the center line of the hull. Therefore, for example, a percentage of a propulsive force effectively applied from the first propulsion device to the hull and a percentage of a propulsive force effectively applied from the second propulsion device to the hull are not necessarily equal to each other, but are dependent on interactions between the hull and water jets generated by the respective propulsion devices. Specifically, when a water jet generated by one of the first propulsion device and the second propulsion device is directed toward the hull for the lateral movement, the propulsive force effectively acting on the hull is influenced by the degree of the interaction between the water jet and the hull. The influence on the lateral movement in one of opposite lateral directions and the influence on the lateral movement in the other lateral direction appear asymmetrically with respect to the center line of the hull. In a preferred embodiment, therefore, when one of the first lateral movement thrust ratio and the second lateral movement thrust ratio is set in the calibration mode, the initial value of the other of the first lateral movement thrust ratio and the second lateral movement thrust ratio is set to the inverse of the one of the first lateral movement thrust ratio and the second lateral movement thrust ratio. This makes it possible to properly set the initial value in consideration of the asymmetric arrangement of the first propulsion device and the second propulsion device, so that calibration to be thereafter performed can be facilitated.

In a preferred embodiment of the present invention, the first propulsion device is an engine propulsion device, and the second propulsion device is an electric propulsion device.

In a preferred embodiment of the present invention, the first propulsion device is located on the center line, and the second propulsion device is offset from the center line. With this arrangement, the first propulsion device and the second propulsion device are in different positional relationships with respect to the center line of the hull, so that the interaction between the hull and the water jet generated by the first propulsion device and the interaction between the hull and the water jet generated by the second propulsion device appear asymmetrically with respect to the center of the hull.

In a preferred embodiment of the present invention, the first propulsion device and the second propulsion device are attachable to the stern of the hull.

In a preferred embodiment of the present invention, the first propulsion device includes a propeller rotation axis lower than the keel of the hull, and the second propulsion device includes a propeller rotation axis higher than the keel of the hull. With this arrangement, the propeller rotation axis of the first propulsion device is located lower than the keel of the hull and, therefore, the interaction between the hull and the water jet generated by the first propulsion device is smaller. In contrast, the propeller rotation axis of the second propulsion device is located higher than the keel of the hull and, therefore, the interaction between the hull and the water jet generated by the second propulsion device is greater. Thus, the interaction between the hull and the water jet generated by the first propulsion device and the interaction between the hull and the water jet generated by the second propulsion device are asymmetrical with respect to the center of the hull.

Another preferred embodiment of the present invention provides a watercraft propulsion system including a first propulsion device attachable to a hull, a second propulsion device attachable to the hull asymmetrically to the first propulsion device with respect to the anteroposterior center line of the hull, a lateral movement command generator to generate a first lateral movement command to laterally move the hull in one of a rightward direction and a leftward direction, and to generate a second lateral movement command to laterally move the hull in the other of the rightward direction and the leftward direction, and a controller. The controller is configured or programmed to perform a first lateral movement control in response to the first lateral movement command to cause one of the first propulsion device and the second propulsion device to generate a reverse propulsive force and cause the other of the first propulsion device and the second propulsion device to generate a forward propulsive force, and to perform a second lateral movement control in response to the second lateral movement command to cause the one of the first propulsion device and the second propulsion device to generate a forward propulsive force and cause the other of the first propulsion device and the second propulsion device to generate a reverse propulsive force. A magnitude relationship between the forward propulsive force and the reverse propulsive force in the first lateral movement control and a magnitude relationship between the forward propulsive force and the reverse propulsive force in the second lateral movement control are reversed from each other.

With this arrangement, the first propulsion device and the second propulsion device are attached to the hull asymmetrically with respect to the center line of the hull. Therefore, for example, the percentage of a propulsive force effectively applied from the first propulsion device to the hull and the percentage of a propulsive force effectively applied from the second propulsion device to the hull are not necessarily equal to each other, but are dependent on interactions between the hull and water jets generated by the respective propulsion devices. Specifically, when a water jet generated by one of the first propulsion device and the second propulsion device is directed toward the hull for the lateral movement, the propulsive force effectively acting on the hull is influenced by the degree of the interaction between the water jet and the hull. The influence on the lateral movement in one of opposite lateral directions and the influence on the lateral movement in the other lateral direction are asymmetrical with respect to the center line of the hull. In a preferred embodiment, therefore, the magnitude relationship between the forward propulsive force and the reverse propulsive force in the first lateral movement control and the magnitude relationship between the forward propulsive force and the reverse propulsive force in the second lateral movement control are reversed from each other. This makes it possible to achieve a proper hull behavior for the lateral movement in either direction.

Another further preferred embodiment of the present invention provides a watercraft including a hull, and a watercraft propulsion system attached to the hull and including any of the above-described features.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
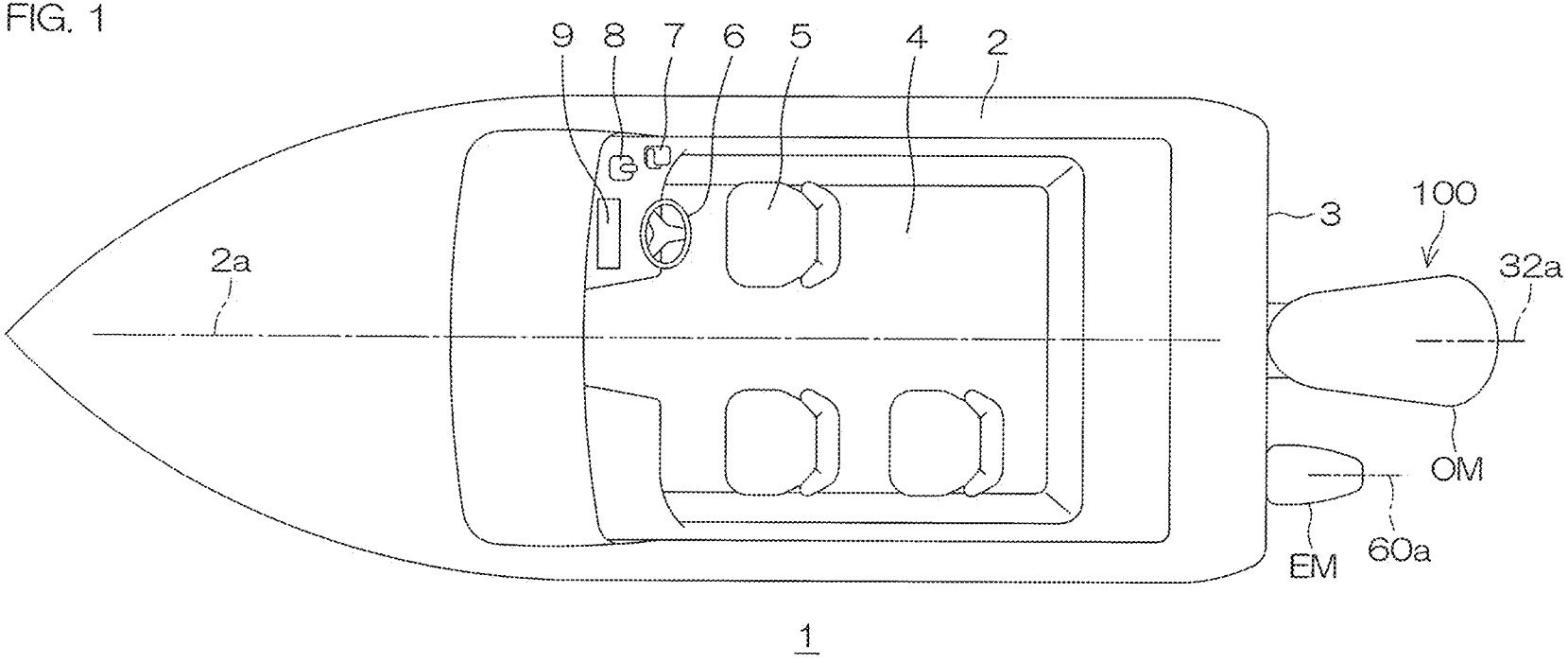
FIG. 1 is a plan view showing an exemplary construction of a watercraft mounted with a watercraft propulsion system according to a preferred embodiment of the present invention.
Figure 2:
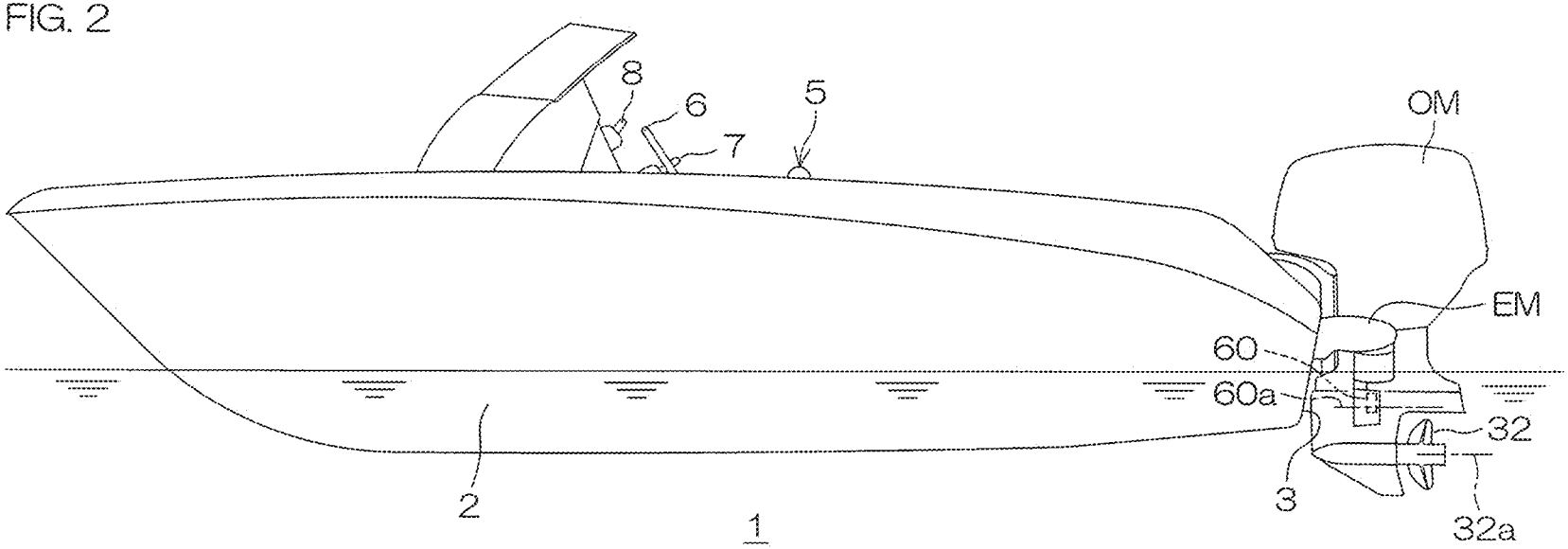
FIG. 2 is a side view of the watercraft as seen from a left side with respect to a bow direction of the watercraft.

FIG. 1 is a plan view showing an exemplary construction of a watercraft 1 mounted with a watercraft propulsion system 100 according to a preferred embodiment of the present invention. FIG. 2 is a side view of the watercraft 1 as seen from a left side with respect to the bow direction of the watercraft 1.

The watercraft 1 includes a hull 2, an engine outboard motor OM attached to the hull 2, and an electric outboard motor EM attached to the hull 2. The engine outboard motor OM and the electric outboard motor EM are examples of the propulsion devices. The engine outboard motor OM is an exemplary main propulsion device. The electric outboard motor EM is an exemplary auxiliary propulsion device having a lower rated output than the main propulsion device. The engine outboard motor OM is an example of the engine propulsion device including an engine as its power source, and corresponds to the first propulsion device. The electric outboard motor EM is an example of the electric propulsion device including an electric motor as its power source, and corresponds to the second propulsion device.

In the present preferred embodiment, the engine outboard motor OM and the electric outboard motor EM are attached to the stern 3 of the watercraft 1. More specifically, the engine outboard motor OM and the electric outboard motor EM are disposed side by side transversely of the hull 2 on the stern 3. In this example, the engine outboard motor OM is disposed on a transversely middle portion of the stern 3, and the electric outboard motor EM is disposed outward (leftward in this example) of the transversely middle portion of the stern 3. That is, the engine outboard motor OM is disposed on the anteroposterior center line 2*a* of the hull 2. The electric outboard motor EM is laterally offset from the center line 2*a*. Therefore, the electric outboard motor EM is attached to the hull 2 asymmetrically to the engine outboard motor OM with respect to the center line 2*a*.

The engine outboard motor OM includes a propeller 32 rotatable about a first propeller rotation axis 32*a*. The electric outboard motor EM includes a propeller 60 rotatable about a second propeller rotation axis 60*a*. The first propeller rotation axis 32*a* and the second propeller rotation axis 60*a* are not coaxial, but have different axes. In the present preferred embodiment, the first propeller rotation axis 32*a* and the second propeller rotation axis 60*a* are spaced apart from each other transversely of the hull 2 as seen in plan. Further, the first propeller rotation axis 32*a* and the second propeller rotation axis 60*a* are located at different heights. The first propeller rotation axis 32*a* extends in a direction conforming to the steering angle and the trim angle of the engine outboard motor OM. The second propeller rotation axis 60*a* extends in a direction conforming to the steering angle and the trim angle of the electric outboard motor EM. Therefore, the first propeller rotation axis 32*a* and the second propeller rotation axis 60*a* may be parallel or non-parallel, and are not in a fixed relationship. Where the propeller 32 of the engine outboard motor OM and the propeller 60 of the electric outboard motor EM are both located underwater, the first propeller rotation axis 32*a* is located lower than the second propeller rotation axis 60*a*.

A usable space 4 for passengers is provided inside the hull 2. A helm seat 5 is provided in the usable space 4. A steering wheel 6, a remote control lever 7, a joystick 8, a gauge 9 (display panel) and the like are provided in association with the helm seat 5. The steering wheel 6 is an operation element operable by an operator to change the course of the watercraft 1. The remote control lever 7 is an operation element operable by the operator to change the magnitude (output) and the direction (forward or reverse direction) of the propulsive force of the engine outboard motor OM, and corresponds to an acceleration operation element. The joystick 8 is an operation element operable instead of the steering wheel 6 and the remote control lever 7 by the operator for maneuvering the watercraft.

Figure 3:
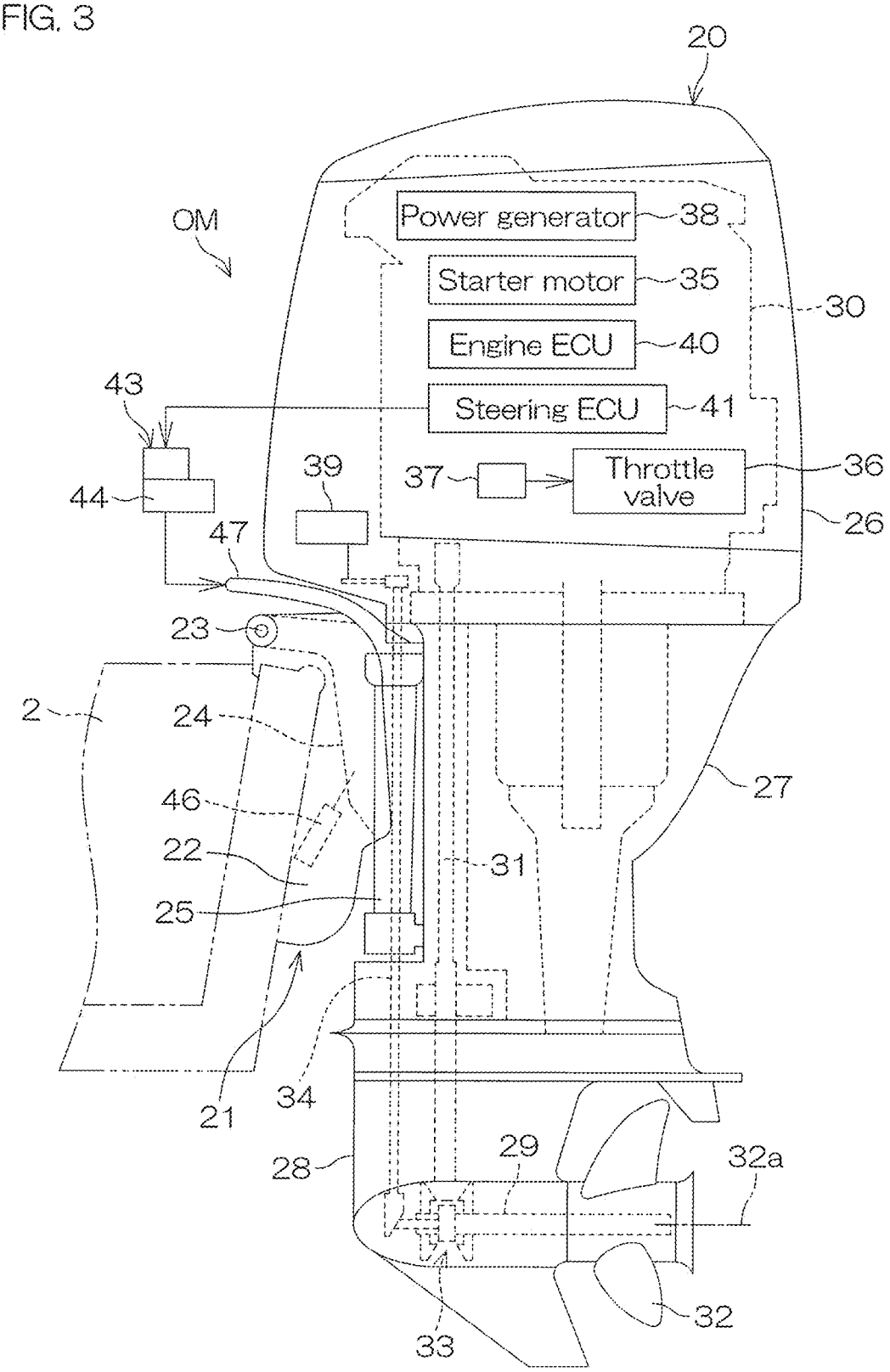
FIG. 3 is a side view showing the structure of an engine outboard motor by way of example.

FIG. 3 is a side view showing the structure of the engine outboard motor OM by way of example. The engine outboard motor OM includes a propulsion unit 20, and an attachment mechanism 21 that attaches the propulsion unit 20 to the hull 2. The attachment mechanism 21 includes a clamp bracket 22 detachably fixed to a transom plate provided on the stern 3 of the hull 2, and a swivel bracket 24 connected to the clamp bracket 22 pivotally about a tilt shaft 23 (horizontal pivot shaft). The propulsion unit 20 is attached to the swivel bracket 24 pivotally about a steering shaft 25. Thus, a steering angle (the azimuth angle of a propulsive force direction with respect to the center line of the hull 2) is changeable by pivoting the propulsion unit 20 about the steering shaft 25. Further, the trim angle of the propulsion unit 20 is changeable by pivoting the swivel bracket 24 about the tilt shaft 23. The trim angle is an angle at which the engine outboard motor OM is attached to the hull 2.

The housing of the propulsion unit 20 includes an engine cover (top cowling) 26, an upper case 27, and a lower case 28. An engine 30 is provided as a prime mover in the engine cover 26 with the axis of its crank shaft extending vertically. A drive shaft 31 for power transmission is connected to the lower end of the crank shaft of the engine 30, and extends vertically through the upper case 27 into the lower case 28.

The propeller 32 is provided as a propulsion member rotatable about the first propeller rotation axis 32*a* at the lower rear side of the lower case 28. A propeller shaft 29, which is the rotation shaft of the propeller 32, extends horizontally along the first propeller rotation axis 32*a* through the lower case 28. The rotation of the drive shaft 31 is transmitted to the propeller shaft 29 via a shift mechanism 33.

The shift mechanism 33 has a plurality of shift positions (shift states) including a forward shift position, a reverse shift position, and a neutral shift position. The neutral shift position corresponds to a cutoff state in which the rotation of the drive shaft 31 is not transmitted to the propeller shaft 29. The forward shift position corresponds to a state such that the rotation of the drive shaft 31 is transmitted to the propeller shaft 29 so as to rotate the propeller shaft 29 in a forward drive rotation direction. The reverse shift position corresponds to a state such that the rotation of the drive shaft 31 is transmitted to the propeller shaft 29 so as to rotate the propeller shaft 29 in a reverse drive rotation direction. The forward drive rotation direction is such that the propeller 32 is rotated so as to apply a forward propulsive force to the hull 2. The reverse drive rotation direction is such that the propeller 32 is rotated so as to apply a reverse propulsive force to the hull 2. The shift position of the shift mechanism 33 is switched by a shift rod 34. The shift rod 34 extends vertically parallel to the drive shaft 31, and is configured so as to be pivoted about its axis to operate the shift mechanism 33.

A starter motor 35 to start the engine 30, and a power generator 38 to generate electric power by the power of the engine 30 after the startup of the engine 30 are provided in association with the engine 30. The starter motor 35 is controlled by an engine ECU (Electronic Control Unit) 40. The electric power generated by the power generator 38 is supplied to electric components provided in the engine outboard motor OM and, in addition, is used to charge batteries 130, 145 (see FIG. 7) accommodated in the hull 2 (see FIGS. 1 and 2). Further, a throttle actuator 37 is provided in association with the engine 30. The throttle actuator 37 actuates the throttle valve 36 of the engine 30 so as to change the throttle opening degree of the engine 30 to change the intake air amount of the engine 30. The throttle actuator 37 may be an electric motor. The operation of the throttle actuator 37 is controlled by the engine ECU 40.

A shift actuator 39 that changes the shift position of the shift mechanism 33 is provided in association with the shift rod 34. The shift actuator 39 is, for example, an electric motor, and the operation of the shift actuator 39 is controlled by the engine ECU 40.

Further, a steering rod 47 is fixed to the propulsion unit 20, and a steering device 43 to be driven according to the operation of the steering wheel 6 (see FIG. 1) is connected to the steering rod 47. The steering device 43 pivots the propulsion unit 20 about the steering shaft 25 to perform a steering operation. The steering device 43 includes a steering actuator 44. The steering actuator 44 is controlled by a steering ECU 41. The steering ECU 41 may be provided in the propulsion unit 20. The steering actuator 44 may be an electric motor, or may be a hydraulic actuator.

A tilt/trim actuator 46 is provided between the clamp bracket 22 and the swivel bracket 24. The tilt/trim actuator 46 includes, for example, a hydraulic cylinder, and is controlled by the engine ECU 40. The tilt/trim actuator 46 pivots the swivel bracket 24 about the tilt shaft 23 to pivot the propulsion unit 20 about the tilt shaft 23.

Figure 4:
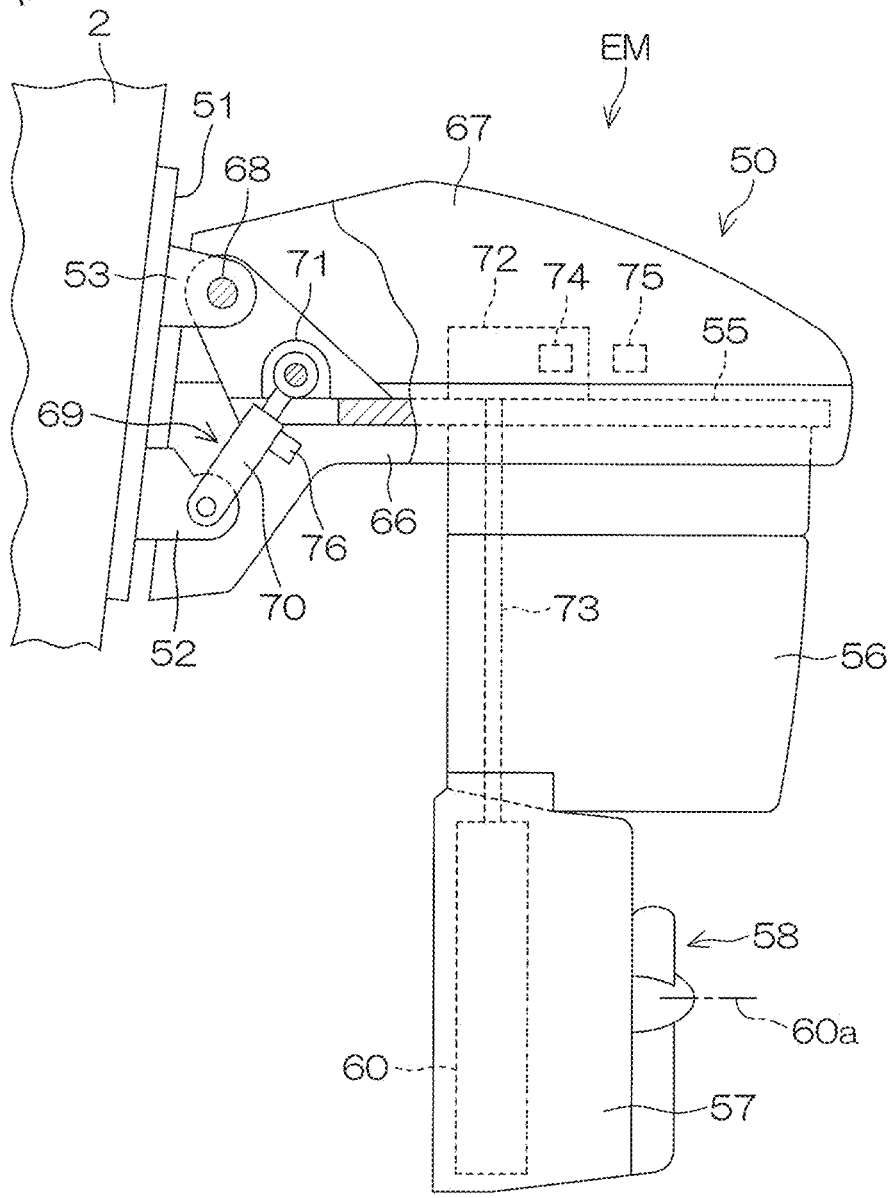
FIG. 4 is a side view showing the structure of an electric outboard motor by way of example.
Figure 5:
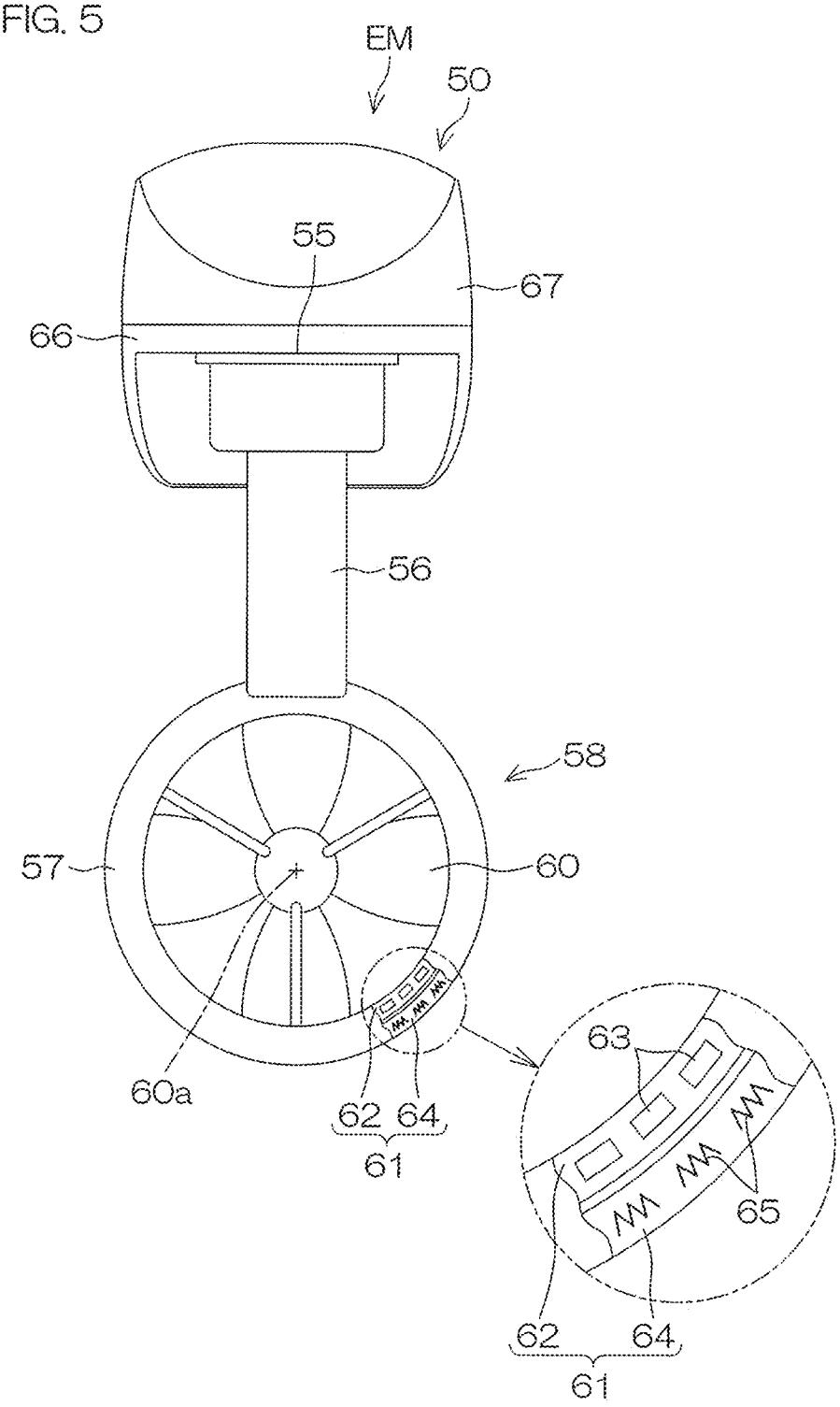
FIG. 5 is a rear view of the electric outboard motor as seen from a rear side of the watercraft.

FIG. 4 is a side view showing the structure of the electric outboard motor EM by way of example, and FIG. 5 is a rear view of the electric outboard motor EM as seen from the rear side of the watercraft 1.

The electric outboard motor EM includes a bracket 51 for attachment thereof to the hull 2, and a propulsion device body 50. The propulsion device body 50 is supported by the bracket 51. The propulsion device body 50 includes a base 55 supported by the bracket 51, an upper housing 56 extending downward from the base 55, a tubular (duct-shaped) lower housing 57 disposed below the upper housing 56, and a drive unit 58 disposed in the lower housing 57. The propulsion device body 50 further includes a cover 66 that covers the base 55 from the lower side, and a cowl 67 that covers the base 55 from the upper side. A tilt unit 69 and a steering unit 72 are accommodated in a space defined by the cover 66 and the cowl 67. Further, a buzzer 75 that generates sound when the tilt unit 69 is actuated may be accommodated in this space.

The drive unit 58 includes the propeller 60, and an electric motor 61 that rotates the propeller 60. The electric motor 61 includes a tubular rotor 62 to which the propeller 60 is fixed radially inward thereof, and a tubular stator 64 that surrounds the rotor 62 from the radially outside. The stator 64 is fixed to the lower housing 57, and the rotor 62 is supported rotatably with respect to the lower housing 57. The rotor 62 includes a plurality of permanent magnets 63 disposed circumferentially thereof. The stator 64 includes a plurality of coils 65 disposed circumferentially thereof. The rotor 62 is rotated by energizing the coils 65 such that the propeller 60 is correspondingly rotated about the second propeller rotation axis 60*a* to generate a propulsive force.

The tilt unit 69 includes a tilt cylinder 70 as a tilt actuator. The tilt cylinder 70 may be a hydraulic cylinder of electric pump type adapted to pump a hydraulic oil by an electric pump. One of opposite ends of the tilt cylinder 70 is connected to the lower support portion 52 of the bracket 51, and the other end of the tilt cylinder 70 is connected to the base 55 via a cylinder connection bracket 71. A tilt shaft 68 is supported by the upper support portion 53 of the bracket 51, and the base 55 is connected to the bracket 51 via the tilt shaft 68 pivotally about the tilt shaft 68. The tilt shaft 68 extends transversely of the hull 2, so that the base 55 is pivotable upward and downward. Thus, the propulsion device body 50 is pivotable upward and downward about the tilt shaft 68.

An expression "tilt-up" means that the propulsion device body 50 is pivoted upward about the tilt shaft 68, and an expression "tilt-down" means that the propulsion device body 50 is pivoted downward about the tilt shaft 68. The tilt cylinder 70 is driven to be extended and retracted such that the tilt-up and the tilt-down are achieved. The propeller 60 is moved up to an above-water position by the tilt-up such that the propulsion device body 50 is brought into a tilt-up state. Further, the propeller 60 is moved down to an underwater position by the tilt-down such that the propulsion device body 50 is brought into a tilt-down state. Thus, the tilt unit 69 is an exemplary lift device that moves up and down the propeller 60.

A tilt angle sensor 76 is provided to detect a tilt angle (i.e., the angle of the propulsion device body 50 with respect to the bracket 51) to detect the tilt-up state and the tilt-down state of the propulsion device body 50. The tilt angle sensor 76 may be a position sensor that detects the position of the actuation rod of the tilt cylinder 70.

The steering unit 72 includes a steering shaft 73 connected to the lower housing 57 and the upper housing 56, and a steering motor 74. The steering motor 74 is an exemplary steering actuator that generates a drive force to pivot the steering shaft 73 about its axis. The steering unit 72 may further include a reduction gear that transmits the rotation of the steering motor 74 to the steering shaft 73 while decelerating the rotation of the steering motor 74. Thus, the lower housing 57 and the upper housing 56 are pivoted about the steering shaft 73 by driving the steering motor 74 such that the direction of the propulsive force generated by the drive unit 58 is changeable leftward and rightward. The upper housing 56 has a plate shape that extents anteroposteriorly of the hull 2 in a neutral steering position, and functions as a rudder plate to be steered by the steering unit 72.

Figure 6A:
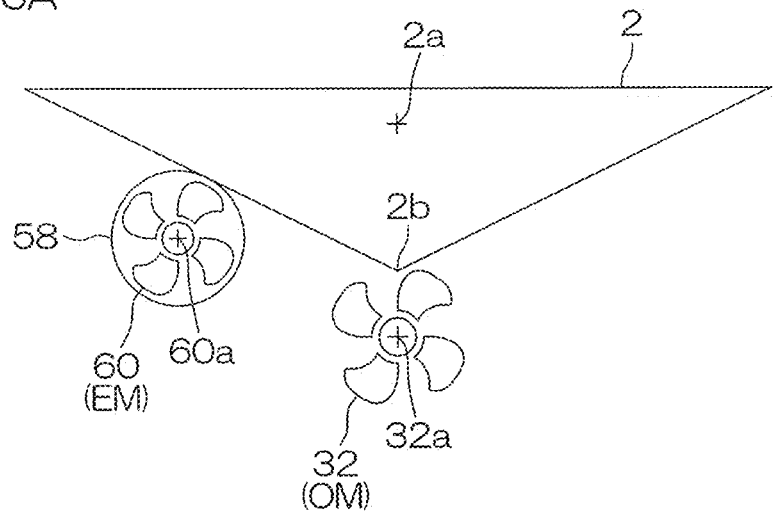
FIG. 6A is a schematic diagram showing the arrangement of the propellers of the engine outboard motor and the electric outboard motor as seen from the rear side of the hull of the watercraft.

FIG. 6A is a diagram schematically illustrating the propellers 32, 60 of the engine outboard motor OM and the electric outboard motor EM as seen from the rear side of the hull 2 for description of the arrangement of the propellers 32, 60.

When the propeller 32 of the engine outboard motor OM and the propeller 60 of the electric outboard motor EM are located underwater, as described above, the first propeller rotation axis 32*a* is located at a lower level than the second propeller rotation axis 60*a*. More specifically, the first propeller rotation axis 32*a* (the propeller rotation axis of the engine outboard motor OM) is located below the keel 2*b* of the hull 2. The first propeller rotation axis 32*a* is located at a transversely middle position of the hull 2. On the other hand, the second propeller rotation axis 60*a* (the propeller rotation axis of the electric outboard motor EM) is located at a higher level than the keel 2*b* of the hull 2. The second propeller rotation axis 60*a* is offset from the transversely middle position of the hull 2.

Since the first propeller rotation axis 32*a* is located below the keel 2*b*, a water jet around the propeller 32 of the engine outboard motor OM is hardly influenced by the hull 2. In contrast, the second propeller rotation axis 60*a* is located at a higher level than the keel 2*b*, so that water jet around the propeller 60 of the electric outboard motor EM is likely to be influenced by the hull 2 depending on the steering angle and the propeller rotation direction of the electric outboard motor EM. Specifically, when the electric outboard motor EM is steered inward to move the rear end of the drive unit 58 (see also FIG. 4) away from the center line 2*a* of the hull 2 and move the front end of the drive unit 58 toward the center line 2*a*, the water jet is more likely to be influenced by the hull 2.

Figure 6B:
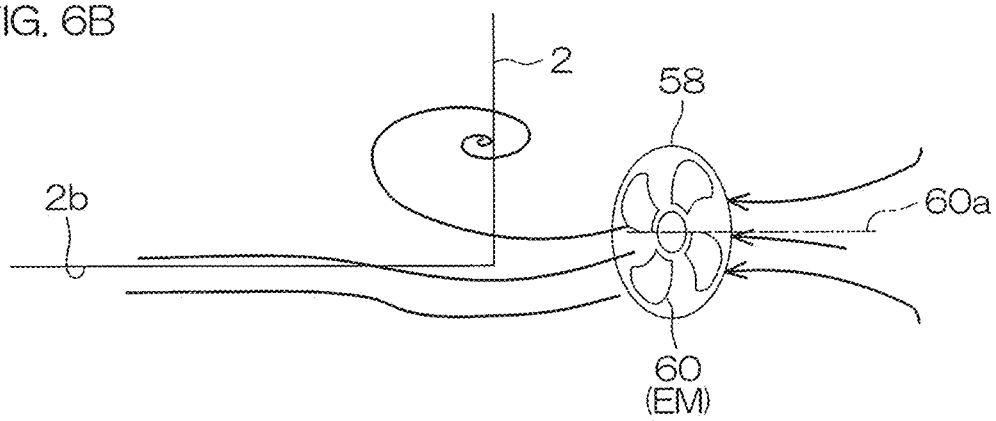
FIG. 6B is a schematic diagram showing how the hull influences a water jet around the propeller of the electric outboard motor.

FIG. 6B is a schematic diagram showing how the hull 2 influences the water jet around the propeller 60 of the electric outboard motor EM. Since the second propeller rotation axis 60*a* is located at a higher level than the keel 2*b*, the water jet around the propeller 60 interferes with the hull 2. In FIG. 6B, the propeller 60 is rotated in reverse, and takes in water from the rear side of the hull 2 and discharges the water toward the hull 2. The discharged water jet interferes with the hull 2 to stagnate such that the propulsive force is reduced. With the propellers 32, 60 of the engine outboard motor OM and the electric outboard motor EM thus arranged in different manners, the magnitudes of propulsive forces effectively acting on the hull 2 are different even if the engine outboard motor OM and the electric outboard motor EM generate propulsive forces of the same magnitude.

In addition, when one of the engine outboard motor OM and the electric outboard motor EM is driven forward and the other outboard motor is driven in reverse, the propeller 60 of the electric outboard motor EM is liable to trap exhaust gas discharged into water from the engine outboard motor OM. This may also reduce the propulsive force of the electric outboard motor EM.

Figure 7:
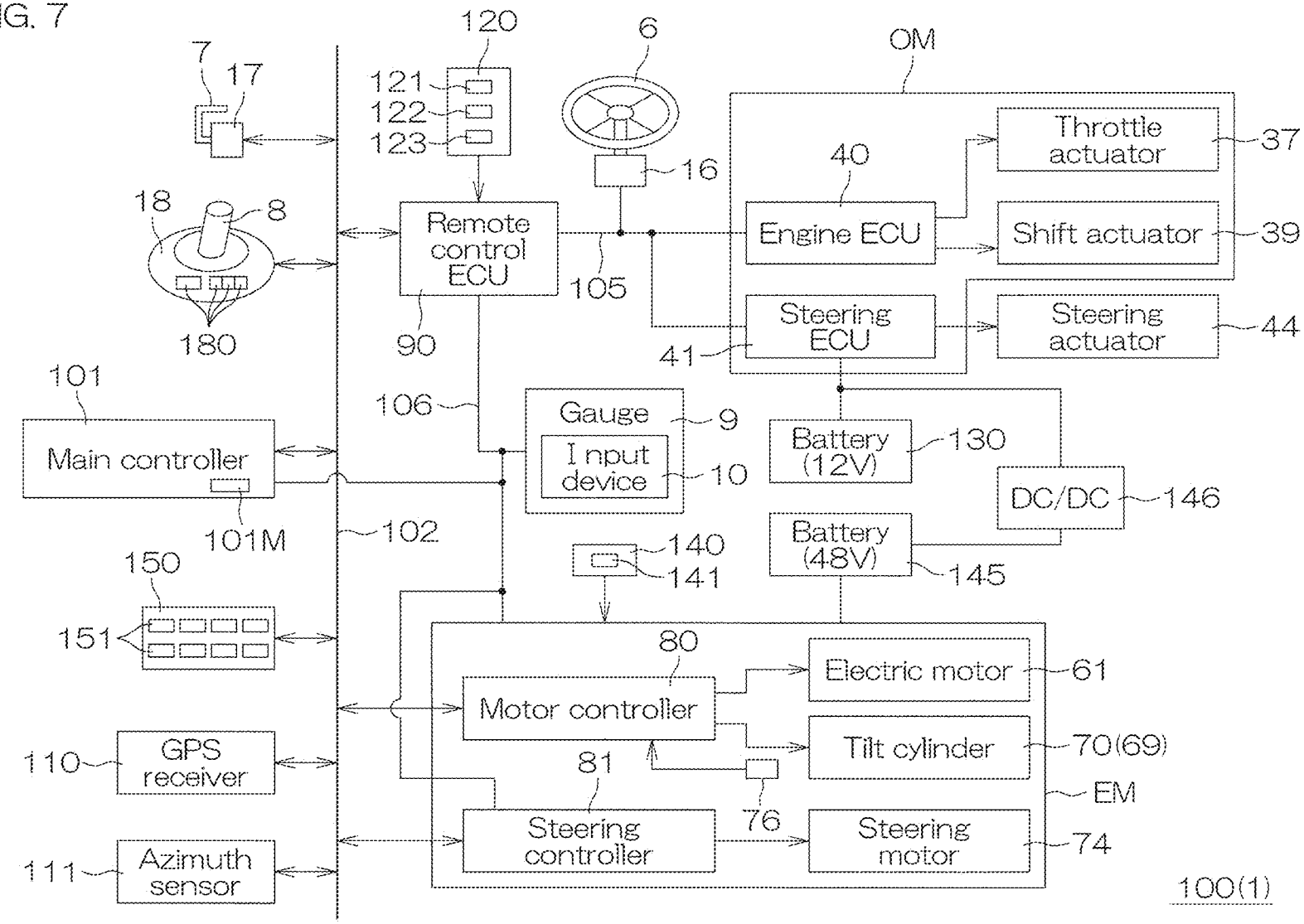
FIG. 7 is a block diagram showing the configuration of the watercraft propulsion system by way of example.

FIG. 7 is a block diagram showing an exemplary configuration of the watercraft propulsion system 100 provided in the watercraft 1. The watercraft propulsion system 100 includes the engine outboard motor OM as the main propulsion device, and the electric outboard motor EM as the auxiliary propulsion device. The watercraft propulsion system 100 includes the lift device to move up and down the propeller 60 of the electric outboard motor EM (see FIGS. 4 and 5) between the underwater position and the above-water position. In the present preferred embodiment, the tilt unit 69 provided in the electric outboard motor EM is an example of the lift device. The lift device such as the tilt unit 69 may be incorporated in the electric outboard motor EM, or may be provided separately from the electric outboard motor EM.

The watercraft propulsion system 100 includes a main controller 101. The main controller 101 is connected to an onboard network 102 (CAN: Control Area Network) provided in the hull 2. A remote control unit 17, a remote control ECU 90, a joystick unit 18, a GPS (Global Positioning System) receiver 110, an azimuth sensor 111, and the like are connected to the onboard network 102. The engine ECU 40 and the steering ECU 41 are connected to the remote control ECU 90 via an outboard motor control network 105. The main controller 101 transmits and receives signals to/from various units connected to the onboard network 102 to control the engine outboard motor OM and the electric outboard motor EM, and further controls other units. The main controller 101 has a plurality of control modes, and controls the units in predetermined manners according to the respective control modes.

A steering wheel unit 16 is connected to the outboard motor control network 105. The steering wheel unit 16 outputs an operation angle signal indicating the operation angle of the steering wheel 6 to the outboard motor control network 105. The operation angle signal is received by the remote control ECU 90 and the steering ECU 41. In response to the operation angle signal generated by the steering wheel unit 16 or a steering angle command applied from the remote control ECU 90, the steering ECU 41 correspondingly controls the steering actuator 44 to control the steering angle of the engine outboard motor OM.

The remote control unit 17 generates an operation position signal indicating the operation position of the remote control lever 7.

The joystick unit 18 generates an operation position signal indicating the operation position of the joystick 8, and generates an operation signal when one of operation buttons 180 of the joystick unit 18 is operated.

The remote control ECU 90 outputs a propulsive force command to the engine ECU 40 via the outboard motor control network 105. The propulsive force command includes a shift command that indicates the shift position of the shift mechanism 33, and an output command that indicates the output (specifically, the rotation speed) of the engine 30. Further, the remote control ECU 90 outputs the steering angle command to the steering ECU 41 via the outboard motor control network 105.

The remote control ECU 90 performs different control operations according to different control modes of the main controller 101. In a control mode for watercraft maneuvering with the use of the steering wheel 6 and the remote control lever 7, for example, the propulsive force command (the shift command and the output command) is generated according to the operation position signal generated by the remote control unit 17, and is applied to the engine ECU 40 by the remote control ECU 90. Further, the remote control ECU 90 commands the steering ECU 41 to conform to the operation angle signal generated by the steering wheel unit 16. In a control mode for watercraft maneuvering without the use of the steering wheel 6 and the remote control lever 7, on the other hand, the remote control ECU 90 conforms to commands applied by the main controller 101. That is, the main controller 101 generates the propulsive force command (the shift command and the output command) and the steering angle command, which are outputted to the engine ECU 40 and the steering ECU 41, respectively, by the remote control ECU 90. In a control mode for watercraft maneuvering with the use of the joystick 8, for example, the main controller 101 generates the propulsive force command (the shift command and the output command) and the steering angle command according to the signals generated by the joystick unit 18. The magnitude and the direction (the forward direction or the reverse direction) of the propulsive force of the engine outboard motor OM and the steering angle of the engine outboard motor OM are controlled according to the propulsive force command (the shift command and the output command) and the steering angle command thus generated.

The engine ECU 40 drives the shift actuator 39 according to the shift command to control the shift position, and drives the throttle actuator 37 according to the output command to control the throttle opening degree. The steering ECU 41 controls the steering actuator 44 according to the steering angle command to control the steering angle of the engine outboard motor OM.

The electric outboard motor EM includes a motor controller 80 and a steering controller 81 connected to the onboard network 102, and is configured to be actuated in response to commands applied from the main controller 101. The main controller 101 applies a propulsive force command and a steering angle command to the electric outboard motor EM. The propulsive force command includes a shift command and an output command. The shift command is a rotation direction command that indicates the stop of the propeller 60, the forward drive rotation of the propeller 60 or the reverse drive rotation of the propeller 60. The output command indicates a propulsive force to be generated, specifically the target value of the rotation speed of the propeller 60. The steering angle command indicates the target value of the steering angle of the electric outboard motor EM. The motor controller 80 controls the electric motor 61 according to the shift command (rotation direction command) and the output command. The steering controller 81 controls the steering motor 74 according to the steering angle command.

Further, the main controller 101 applies a tilt command to the motor controller 80 via the onboard network 102. The tilt command indicates the target value of the tilt angle of the electric outboard motor EM. The motor controller 80 actuates the tilt cylinder 70 according to the tilt command to tilt up or down the electric outboard motor EM to the target tilt angle. The detection signal of the tilt angle sensor 76 is inputted to the motor controller 80. Thus, the motor controller 80 can acquire the information of the tilt angle of the propulsion device body 50, and transmit the tilt angle information to the main controller 101.

The GPS receiver 110 detects the position of the watercraft 1 by receiving radio waves from an artificial satellite orbiting the earth, and outputs position data indicating the position of the watercraft 1 and speed data indicating the moving speed of the watercraft 1. The main controller 101 acquires the position data and the speed data, which are used to control and display the position and/or the azimuth of the watercraft 1.

The azimuth sensor 111 detects the azimuth of the watercraft 1, and generates azimuth data, which is used by the main controller 101.

The gauge 9 is connected to the main controller 101 via a control panel network 106. The gauge 9 is a display device that displays various information for the watercraft maneuvering. The gauge 9 is connected to the remote control ECU 90, the motor controller 80, and the steering controller 81 via the control panel network 106. Thus, the gauge 9 can display information such as of the operation state of the engine outboard motor OM, the operation state of the electric outboard motor EM, and the position and/or the azimuth of the watercraft 1. The gauge 9 may include an input device 10 such as a touch panel and buttons. The input device 10 may be operated by the operator to set various settings and give various commands such that operation signals are outputted to the control panel network 106.

A power switch unit 120 operable to turn on a power supply to the engine outboard motor OM and to start and stop the engine 30 is connected to the remote control ECU 90. The power switch unit 120 includes a power switch 121 operable to turn on and off the power supply to the engine outboard motor OM, a start switch 122 operable to start the engine 30, and a stop switch 123 operable to stop the engine 30.

With the power switch 121 turned on, the remote control ECU 90 performs a power supply control to control the power supply to the engine outboard motor OM. Specifically, a power supply relay (not shown) provided between the battery 130 (e.g., 12 V) and the engine outboard motor OM is turned on. When the start switch 122 is operated with the power supply to the engine outboard motor OM turned on, the remote control ECU 90 applies a start command to the engine ECU 40. Thus, the engine ECU 40 actuates the starter motor 35 (see FIG. 3) to start the engine 30. During the operation of the engine 30, the battery 130 is charged with the electric power generated by the power generator 38 (see FIG. 3). When the stop switch 123 is operated during the operation of the engine 30, the remote control ECU 90 applies an engine stop command to the engine ECU 40. In response to the engine stop command, the engine ECU 40 performs a stop control operation to stop the engine 30. Engine outboard motor state information indicating whether or not the power supply to the engine outboard motor OM is turned on and whether or not the engine 30 is in operation is applied to the main controller 101 via the onboard network 102 by the remote control ECU 90.

A power switch unit 140 operable to turn on and off a power supply to the electric outboard motor EM is connected to the electric outboard motor EM. By turning on and off a power switch 141 provided in the power switch unit 140, a circuit connected between the electric outboard motor EM and the battery 145 (e.g., 48 V) that supplies the electric power to the electric outboard motor EM is closed and opened to turn on and off the power supply to the electric outboard motor EM. Electric outboard motor state information indicating whether or not the electric outboard motor EM is turned on, i.e., whether or not the electric outboard motor EM is in a drivable state, is applied to the main controller 101 via the onboard network 102 by the motor controller 80. The battery 145 is able to receive the electric power generated by the power generator 38 (see FIG. 3) of the engine outboard motor OM via a DC/DC convertor 146 (voltage transformer).

Further, an application switch panel 150 is connected to the onboard network 102. The application switch panel 150 includes a plurality of function switches 151 operable to apply predefined function commands. For example, the function switches 151 may include switches for automatic watercraft maneuvering commands. Specific examples of the function switches 151 may include switches for an automatic steering function of maintaining the azimuth of the watercraft 1, for an automatic steering function of maintaining the course of the watercraft 1, for an automatic steering function of causing the watercraft 1 to pass through a plurality of checkpoints sequentially, and for an automatic steering function of causing the watercraft 1 to sail along a predetermined pattern (zig-zag pattern, spiral pattern or the like). A function for the tilt-up or the tilt-down of the electric outboard motor EM may be assigned to one of the function switches 151.

The main controller 101 is able to control the engine outboard motor OM and the electric outboard motor EM in a plurality of control modes. The control modes include a plurality of modes each defined by the state of the engine outboard motor OM and the state of the electric outboard motor EM. Specific examples of the control modes include an electric mode, an engine mode, a dual mode, and an extender mode. The main controller 101 operates according to any one of these control modes based on the engine outboard motor state information and the electric outboard motor state information.

In the electric mode, the power supply to the electric outboard motor EM is turned on, and the power supply to the engine outboard motor OM is turned off. That is, only the electric outboard motor EM generates the propulsive force in the electric mode. In the engine mode, the engine 30 is in operation with the power supply to the engine outboard motor OM turned on, and the power supply to the electric outboard motor EM is turned off. That is, only the engine outboard motor OM generates the propulsive force in the engine mode. In the dual mode and the extender mode, the power supply to the electric outboard motor EM is turned on, and the engine 30 of the engine outboard motor OM is in operation. In the dual mode, the propulsive force generated by the engine outboard motor OM and the propulsive force generated by the electric outboard motor EM are both utilized. In the extender mode, only the propulsive force generated by the electric outboard motor EM is utilized, and the engine 30 is driven to generate the electric power to charge the battery 145. In the electric mode and the extender mode, the electric outboard motor EM generates the propulsive force likewise. The operator may set a setting or provide a command to select the dual mode or the extender mode. For example, the operator may operate the input device 10 provided in the gauge 9 to set the setting or provide the command.

Figure 8:
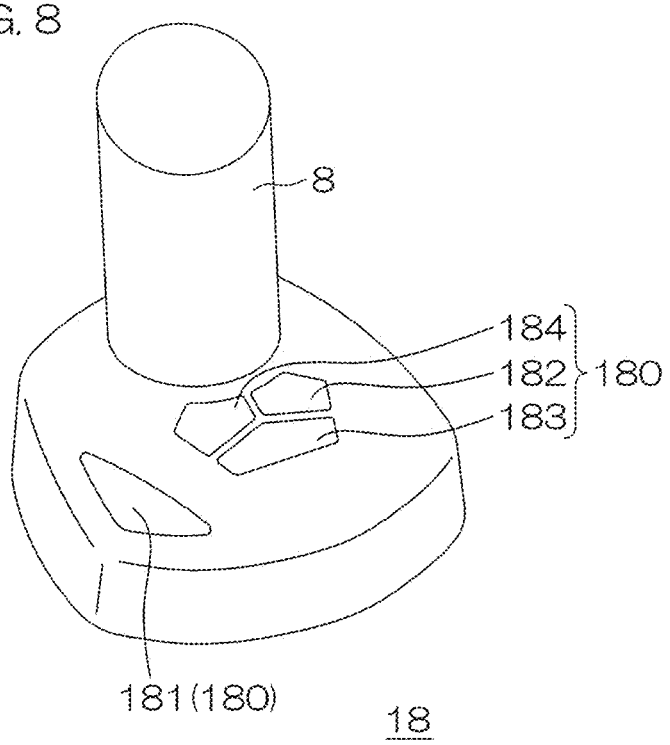
FIG. 8 is a perspective view showing the structure of a joystick unit by way of example.

FIG. 8 is a perspective view showing the structure of the joystick unit 18 by way of example. The joystick unit 18 includes the joystick 8, which is inclinable forward, backward, leftward, and rightward (i.e., in all 360-degree directions) and is pivotable (twistable) about its axis. In this example, the joystick unit 18 further includes a plurality of operation buttons 180. The operation buttons 180 include a joystick button 181 and holding mode setting buttons 182 to 184.

The joystick button 181 is an operation element operable by the operator to select a control mode (watercraft maneuvering mode) utilizing the joystick 8, i.e., a joystick mode.

The holding mode setting buttons 182, 183, 184 are operation buttons operable by the operator to select position/azimuth holding system control modes (examples of the holding mode). More specifically, the holding mode setting button 182 is operated to select a fixed point holding mode (Stay Point™) in which the position and the bow azimuth (or the stern azimuth) of the watercraft 1 are maintained. The holding mode setting button 183 is operated to select a position holding mode (Fish Point™) in which the position of the watercraft 1 is maintained but the bow azimuth (or the stern azimuth) of the watercraft 1 is not maintained. The holding mode setting button 184 is operated to select an azimuth holding mode (Drift Point™) in which the bow azimuth (or the stern azimuth) of the watercraft 1 is maintained but the position of the watercraft 1 is not maintained.

The control mode of the main controller 101 is classified into an ordinary mode, the joystick mode, or the holding mode in terms of operation system.

In the ordinary mode, a steering control operation is performed according to the operation angle signal generated by the steering wheel unit 16, and a propulsive force control operation is performed according to the operation signal (operation position signal) of the remote control lever 7. In the present preferred embodiment, the ordinary mode is a default control mode of the main controller 101. In the steering control operation, specifically, the steering ECU 41 drives the steering actuator 44 according to the operation angle signal generated by the steering wheel unit 16 or the steering angle command applied from the remote control ECU 90. Thus, the body of the engine outboard motor OM is steered leftward and rightward such that the propulsive force direction is changed leftward and rightward with respect to the hull 2. In the propulsive force control operation, specifically, the engine ECU 40 drives the shift actuator 39 and the throttle actuator 37 according to the propulsive force command (the shift command and the output command) applied to the engine ECU 40 by the remote control ECU 90. Thus, the shift position of the engine outboard motor OM is set to the forward shift position, the reverse shift position, or the neutral shift position, and the engine output (specifically, the engine rotation speed) is changed.

In the joystick mode, the steering control operation and the propulsive force control operation are performed according to the operation signal of the joystick 8 of the joystick unit 18.

In the joystick mode, the steering control operation and the propulsive force control operation are performed on the engine outboard motor OM if the engine outboard motor OM is in a propulsive force generatable state. That is, the main controller 101 applies the steering angle command and the propulsive force command to the remote control ECU 90, and the remote control ECU 90 applies the steering angle command and the propulsive force command to the steering ECU 41 and the engine ECU 40, respectively.

In the joystick mode, the steering control operation and the propulsive force control operation are performed on the electric outboard motor EM if the electric outboard motor EM is in a propulsive force generatable state. In the steering control operation on the electric outboard motor EM, specifically, the steering controller 81 of the electric outboard motor EM drives the steering unit 72 according to the steering angle command applied to the steering controller 81 by the main controller 101. Thus, the drive unit 58 and the upper housing 56 of the electric outboard motor EM are pivoted leftward and rightward such that the propulsive force direction is changed leftward and rightward with respect to the hull 2. In the propulsive force control operation on the electric outboard motor EM, specifically, the motor controller 80 of the electric outboard motor EM controls the rotation direction and the rotation speed of the electric motor 61 according to the propulsive force command (the shift command and the output command) applied to the motor controller 80 by the main controller 101. Thus, the rotation direction of the propeller 60 is set to a forward drive rotation direction or a reverse drive rotation direction, and the rotation speed of the propeller 60 is changed.

Figure 9B:
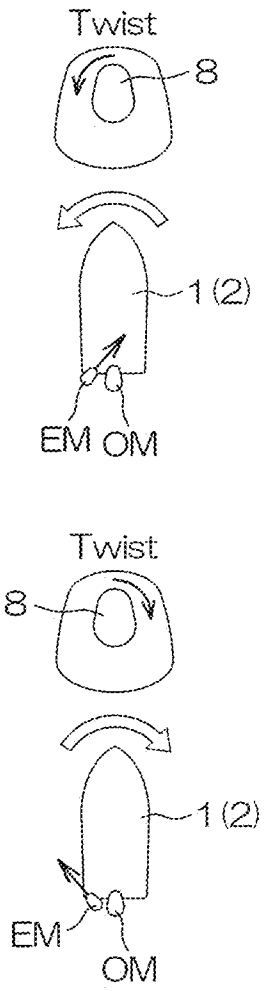
FIGS. 9A and 9B are diagrams for describing exemplary operations to be performed in a first joystick mode by utilizing the propulsive forces of two propulsion devices.
Figure 9A:
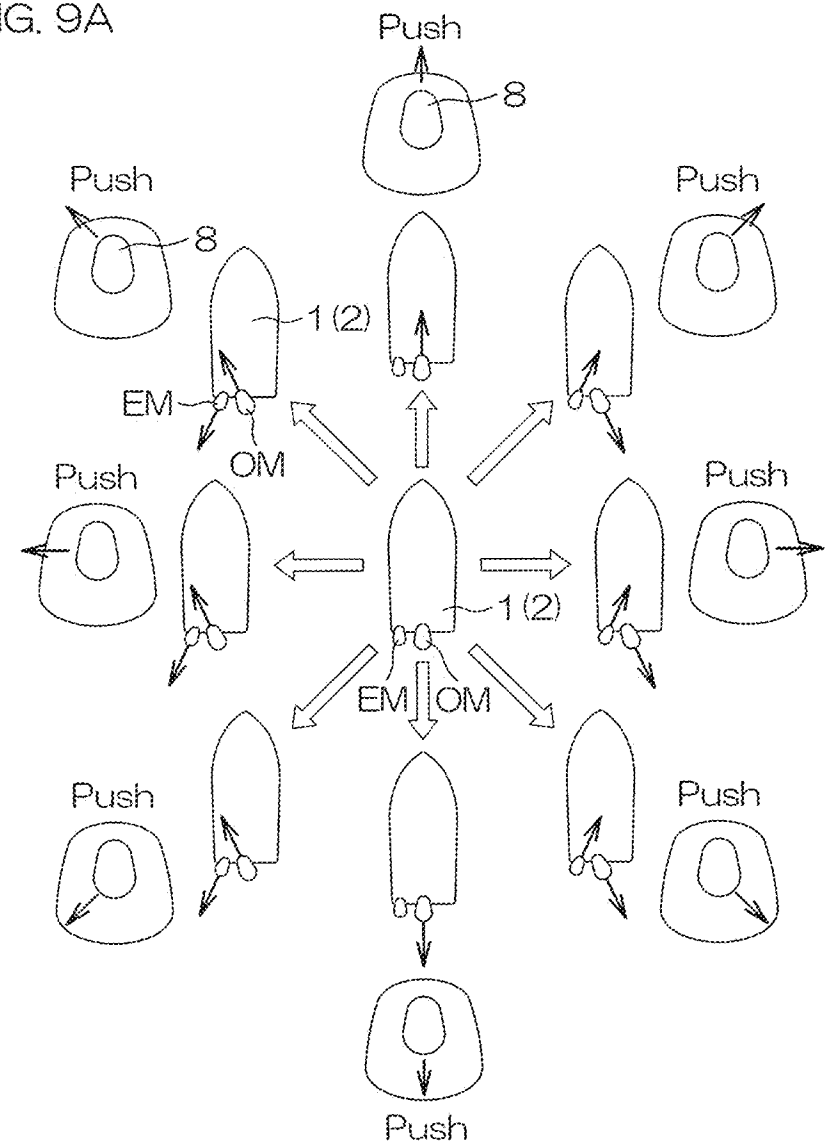
Figure 10:
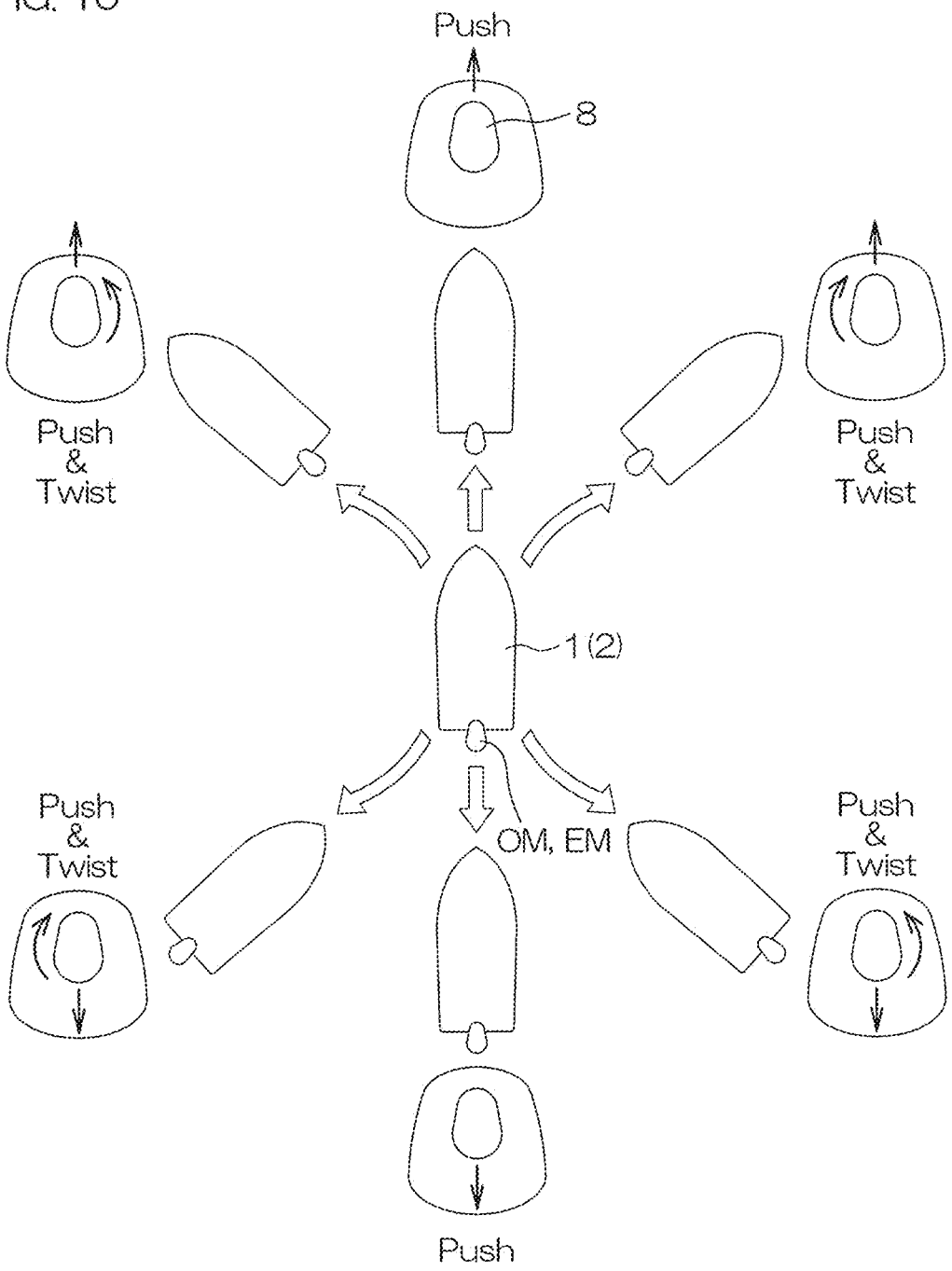
FIG. 10 is a diagram for describing an exemplary operation to be performed in a second joystick mode by utilizing the propulsive force of a single propulsion device.

FIGS. 9A, 9B, and 10 are diagrams for describing two types of joystick modes, and showing the operation states of the joystick 8 and the corresponding behaviors of the hull 2. More specifically, FIGS. 9A and 9B show exemplary operations to be performed in a first joystick mode in which propulsive forces generated by the two propulsion devices (in the present preferred embodiment, the engine outboard motor OM and the electric outboard motor EM) are both utilized. FIG. 10 shows an exemplary operation to be performed in a second joystick mode in which a propulsive force generated by only one of the propulsion devices (in the present preferred embodiment, one of the engine outboard motor OM and the electric outboard motor EM) is utilized.

When the joystick mode is commanded by operating the joystick button 181 in the dual mode, the main controller 101 performs the control operation according to the first joystick mode. When the joystick mode is commanded by operating the joystick button 181 in any one of the modes other than the dual mode (the electric mode, the engine mode, or the extender mode), the main controller 101 performs the control operation according to the second joystick mode.

In the first joystick mode shown in FIGS. 9A and 9B, the main controller 101 defines the inclination direction of the joystick 8 as an advancing direction command, and defines the inclination amount of the joystick 8 as a propulsive force magnitude command that indicates the magnitude of the propulsive force to be applied in the advancing direction. Further, the main controller 101 defines the pivoting direction of the joystick 8 about its axis (with respect to the neutral position of the joystick 8) as a bow turning direction command, and defines the pivoting amount of the joystick 8 (with respect to the neutral position of the joystick 8) as a bow turning speed command. For execution of these commands, the steering angle command and the propulsive force command are generated by the main controller 101 and inputted to the remote control ECU 90 and to the steering controller 81 and the motor controller 80 of the electric outboard motor EM. The remote control ECU 90 transmits the steering angle command and the propulsive force command to the steering ECU 41 and the engine ECU 40, respectively, of the engine outboard motor OM. Thus, the engine outboard motor OM is steered to a steering angle according to the steering command, and the shift position and the engine rotation speed of the engine outboard motor OM are controlled so as to generate a propulsive force according to the propulsive force command. Further, the drive unit 58 and the upper housing 56 of the electric outboard motor EM are steered to a steering angle according to the steering command, and the rotation direction and the rotation speed of the electric motor 61 of the electric outboard motor EM are controlled so as to generate a propulsive force according to the propulsive force command.

When the joystick 8 is inclined without being pivoted in the first joystick mode, the hull 2 is moved in a direction corresponding to the inclination direction of the joystick 8 without the bow turning, i.e., with its azimuth maintained. That is, the hull 2 is in a hull behavior of translation movement. Examples of the translation movement are shown in FIG. 9A. In general, the translation movement is typically achieved by driving one of the two propulsion devices forward and driving the other propulsion device reverse with the propulsive force action lines of the two propulsion devices (extending along the respective propulsive force directions) crossing each other in the hull 2. Thus, the hull 2 translates in the direction of the resultant force of the propulsive forces generated by the two outboard motors OM, EM. In the examples shown in FIG. 9A, however, only the propulsive force of the engine outboard motor OM is utilized to move the hull 2 forward in the bow direction and rearward in the stern direction.

When the joystick 8 is pivoted (twisted) without being inclined in the first joystick mode, the bow of the hull 2 is turned in a direction corresponding to the pivoting direction of the joystick 8 without any substantial position change. That is, the hull 2 is in a fixed-point bow turning behavior. Examples of the fixed-point bow turning behavior are shown in FIG. 9B. In these examples, only the propulsive force of the electric outboard motor EM is utilized for the fixed-point bow turning behavior.

When the joystick 8 is inclined and pivoted in the first joystick mode, the hull 2 is in a hull behavior such that the bow is turned in a direction corresponding to the pivoting direction of the joystick 8 while the hull 2 is moved in a direction corresponding to the inclination direction of the joystick 8. In general, however, the watercraft maneuvering operation is more easily performed by inclining the joystick 8 for the hull translation (see FIG. 9A) for the adjustment of the position of the hull 2 and by pivoting the joystick 8 for the fixed-point bow turning (see FIG. 9B) for the adjustment of the azimuth of the hull 2.

In the second joystick mode shown in FIG. 10, the propulsive force generated by only one of the two propulsion devices is utilized and, therefore, the hull translation (see FIG. 9A) which utilizes the resultant force of the propulsive forces of the two propulsion devices is impossible. That is, the second joystick mode is a control mode that disables a certain hull behavior (specifically, the translation movement) available in the first joystick mode. In the examples shown in FIG. 9B, only the propulsive force of the electric outboard motor EM is utilized, so that the fixed-point bow turning behavior is available not only in the dual mode but also in the electric mode and the extender mode.

In the second joystick mode, the main controller 101 defines the anteroposterior inclination of the joystick 8 as the propulsive force command (the shift command and the output command), and ignores the lateral inclination of the joystick 8. That is, when the joystick 8 is inclined, only the anteroposterior directional component of the inclination direction of the joystick 8 serves as an effective input, and is defined as the propulsive force command. More specifically, if the anteroposterior directional component has a value indicating the forward inclination, the anteroposterior directional component is defined as a forward shift command. If the anteroposterior directional component has a value indicating the rearward inclination, the anteroposterior directional component is defined as a reverse shift command. Further, the magnitude of the anteroposterior directional component is defined as a command (output command) indicating the magnitude of the propulsive force. The propulsive force command (the shift command and the output command) thus defined is inputted from the main controller 101 to the remote control ECU 90 (in the engine mode) or to the motor controller 80 (in the electric mode or the extender mode). On the other hand, the main controller 101 defines the axial pivoting of the joystick 8 as the steering angle command in the second joystick mode. That is, the main controller 101 generates the steering angle command according to the axial pivoting direction and the pivoting amount of the joystick 8, and inputs the steering angle command to the remote control ECU 90 (in the engine mode) or to the steering controller 81 (in the electric mode or the extender mode).

In the engine mode, the remote control ECU 90 transmits the steering angle command and the propulsive force command to the steering ECU 41 and the engine ECU 40, respectively. Thus, the engine outboard motor OM is steered to a steering angle according to the steering angle command, and the shift position and the engine rotation speed of the engine outboard motor OM are controlled so as to generate a propulsive force according to the propulsive force command. In the electric mode or the extender mode, the motor controller 80 drives the electric motor 61 according to the propulsive force command, and the steering controller 81 drives the steering motor 74 according to the steering angle command.

The fixed point holding mode (Stay Point™), the position holding mode (Fish Point™), and the azimuth holding mode (Drift Point™) to be selected by operating the holding mode setting buttons 182, 183 and 184, respectively, are examples of the holding mode. In these holding modes, the outputs and the steering angles of the engine outboard motor OM and/or the electric outboard motor EM are controlled without any manual operation by the operator.

In the fixed point holding mode (Stay Point™), for example, the main controller 101 controls the outputs and the steering angles of the engine outboard motor OM and the electric outboard motor EM based on the position data and the speed data generated by the GPS receiver 110 and the azimuth data outputted from the azimuth sensor 111. Thus, the positional change and the azimuthal change of the hull 2 are reduced. The fixed point holding mode is available in the dual mode.

In the position holding mode (Fish Point™), the main controller 101 controls the output and the steering angle of at least one of the engine outboard motor OM and the electric outboard motor EM based on the position data and the speed data generated by the GPS receiver 110. Thus, the positional change of the hull 2 is reduced.

In the azimuth holding mode (Drift Point™), the main controller 101 controls the output and the steering angle of at least one of the engine outboard motor OM and the electric outboard motor EM based on the azimuth data generated by the azimuth sensor 111. Thus, the azimuthal change of the hull 2 is reduced.

The position holding mode and the azimuth holding mode are available in any of the electric mode, the engine mode, the dual mode, and the extender mode.

Figure 11A:
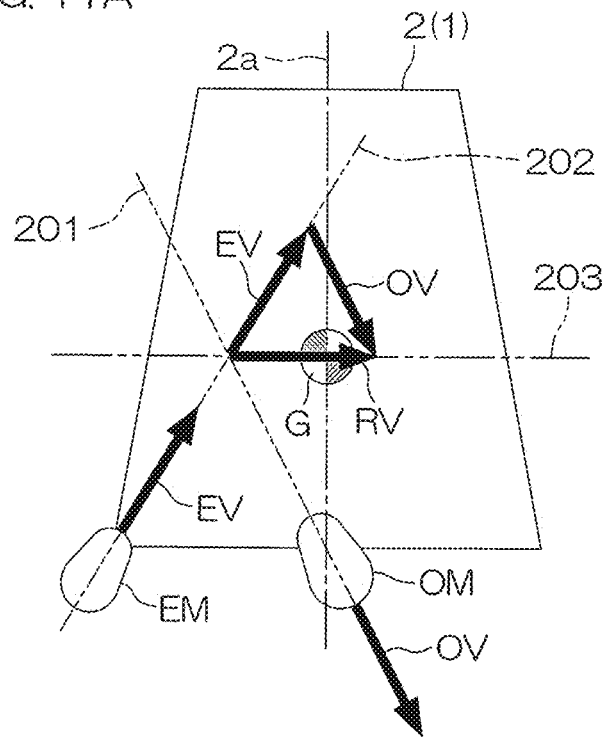
FIGS. 11A and 11B are vector diagrams each showing lateral translation movement, i.e., showing a relationship between propulsive forces for lateral movement.
Figure 11B:
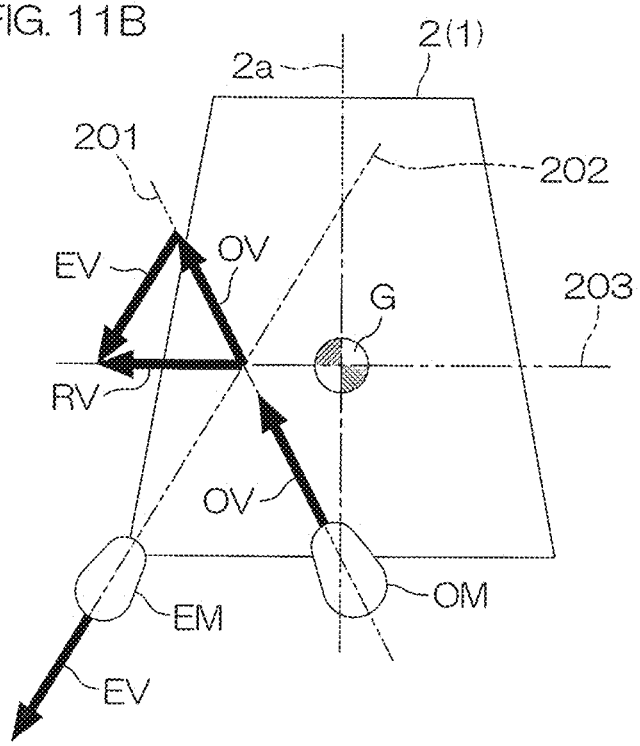

FIGS. 11A and 11B are vector diagrams showing lateral translation movement, i.e., showing a relationship between the propulsive forces for the lateral movement.

The lateral movement includes a rightward translation movement and a leftward translation movement in the first joystick mode. When the operator inclines the joystick 8 rightward, the joystick unit 18 generates a rightward lateral movement command (an example of the first lateral movement command) for the rightward lateral movement. When the operator inclines the joystick 8 leftward, the joystick unit 18 generates a leftward lateral movement command (an example of the second lateral movement command) for the leftward lateral movement. Therefore, the joystick unit 18 is an example of the lateral movement command generator to generate the lateral movement commands. When the rightward lateral movement command is inputted, the main controller 101 performs a rightward lateral movement control (an example of the first lateral movement control) to control the engine outboard motor OM and the electric outboard motor EM for the rightward lateral movement. When the leftward lateral movement command is inputted, the main controller 101 performs a leftward lateral movement control (an example of the second lateral movement control) to control the engine outboard motor OM and the electric outboard motor EM for the leftward lateral movement.

FIG. 11A shows the rightward lateral movement control by way of example. The engine outboard motor OM, which is a right one of the two propulsion devices, is controlled to generate a reverse propulsive force with its shift position set at the reverse shift position. The electric outboard motor EM, which is a left one of the two propulsion devices, is controlled to be driven forward to generate a forward propulsive force. On the other hand, the engine outboard motor OM and the electric outboard motor EM are steered to move their rear ends away from each other. Thus, the steering angles of the engine outboard motor OM and the electric outboard motor EM are controlled so that propulsive force action lines 201, 202 respectively defined by lines extending along the vectors OV, EV of the propulsive forces generated by the engine outboard motor OM and the electric outboard motor EM cross each other in the hull 2 as seen in plan. At this time, the resultant force of the propulsive forces generated by the two propulsion devices may be considered to act on the hull 2 at the intersection of the two propulsive force action lines 201, 202. Where a resultant force action line 203 defined by a line extending along the vector RV of the resultant force passes through the turning center G of the hull 2, the resultant force applies no moment to the hull 2, so that the hull 2 can translate. Where the resultant force action line 203 passing through the turning center G is parallel to the transverse direction of the hull 2, the hull 2 can be moved laterally rightward. The steering angles, the forward/reverse drive directions and the outputs of the engine outboard motor OM and the electric outboard motor EM are thus controlled in the rightward lateral movement control. In FIGS. 11A and 11B, the turning center G is located on the anteroposterior center line 2*a* of the hull 2 by way of example, but the position of the turning center G is generally unknown.

Similarly, FIG. 11B shows the leftward lateral movement control by way of example. The engine outboard motor OM, which is a right one of the two propulsion devices, is controlled to generate a forward propulsive force with its shift position set at the forward shift position. The electric outboard motor EM, which is a left one of the two propulsion devices, is controlled to be driven in reverse to generate a reverse propulsive force. On the other hand, the engine outboard motor OM and the electric outboard motor EM are steered to move their rear ends away from each other. Thus, the steering angles of the engine outboard motor OM and the electric outboard motor EM are controlled so that the propulsive force action lines 201, 202 defined by the lines extending along the vectors OV, EV of the propulsive forces generated by the engine outboard motor OM and the electric outboard motor EM cross each other in the hull 2 as seen in plan. As in the case of FIG. 11A, the resultant force of the propulsive forces generated by the two propulsion devices may be considered to act on the hull 2 at the intersection of the two propulsive force action lines 201, 202. Where the resultant force action line 203 defined by the line extending along the vector RV of the resultant force passes through the turning center G of the hull 2, the resultant force applies no moment to the hull 2, so that the hull 2 can translate. Where the resultant force action line 203 passing through the turning center G is parallel to the transverse direction of the hull 2, the hull 2 can be moved laterally leftward. The steering angles, the forward/reverse drive directions, and the outputs of the engine outboard motor OM and the electric outboard motor EM are thus controlled in the leftward lateral movement control.

As described above, the position of the turning center G varies depending on the construction of the watercraft. Therefore, calibration should be preliminarily performed for the rightward lateral movement control and for the leftward lateral movement control. This makes it possible to achieve the lateral movement as intended by the operator according to the operation of the joystick 8.

Specific examples of a calibration procedure and a process to be performed by the main controller 101 will be described below. Either of the rightward lateral movement calibration and the leftward lateral movement calibration may be performed first. A procedure and a process in which the rightward lateral movement calibration is first performed and then the leftward lateral movement calibration is performed will hereinafter be described. A procedure and a process in which the leftward lateral movement calibration is first performed and then the rightward lateral movement calibration is performed can be provided by exchanging between "the rightward lateral movement" and "the leftward lateral movement" in the following description.

Figure 12:
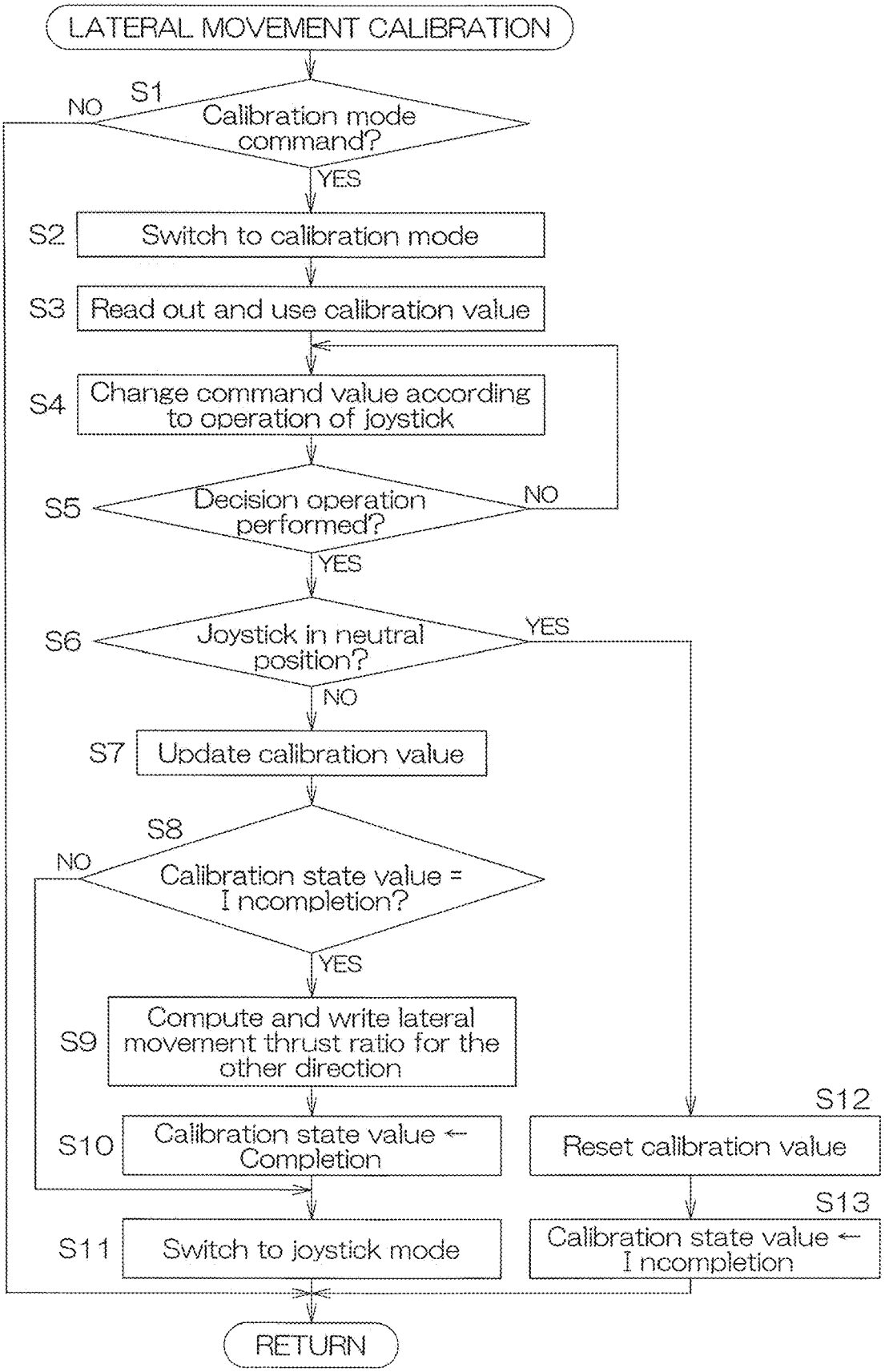
FIG. 12 is a flowchart showing an exemplary process to be performed by a main controller for lateral movement calibration.

FIG. 12 is a flowchart showing the process to be performed by the main controller 101 for the lateral movement calibration.

The operator can start the rightward lateral movement calibration by performing a predetermined calibration start operation to apply a calibration mode command to the main controller 101. The calibration start operation may be, for example, long-pressing of the joystick button 181. If the calibration start operation is performed (YES in Step S1), the control mode of the main controller 101 is switched to the calibration mode (Step S2). The operator may be notified of the calibration mode by an indicator such as an LED lamp (not shown) provided in the joystick unit 18.

Upon the switching to the calibration mode, the main controller 101 reads out a calibration value from a memory 101M and, when the operator operates the joystick 8, the main controller 101 generates a propulsive force command and a steering angle command by using the calibration value (Step S3). If the calibration value is used for the first time for the calibration, the calibration value is a default value preliminarily written in the memory 101M. Where the calibration has been previously performed, the calibration value is a value set for the previous calibration. However, the calibration value set for the previous calibration can be reset to the default value by a reset operation to be described below.

In the calibration mode, the operator performs a rightward lateral movement operation, i.e., inclines the joystick 8 rightward, for the rightward lateral movement calibration. The operator observes the behavior of the hull 2. If the hull 2 is moved right-forward, the operator changes the inclination direction of the joystick 8 to a right rearward direction in order to correct the hull movement. If the hull 2 is moved right-rearward, the operator changes the inclination direction of the joystick 8 to a right forward direction in order to correct the hull movement. If the bow of the hull 2 is turned clockwise, the operator twists the joystick 8 counterclockwise in order to correct the bow turning. If the bow of the hull 2 is turned counterclockwise, the operator twists the joystick 8 clockwise in order to correct the bow turning.

According to the operation of the joystick 8, the operation signal of the joystick 8 is inputted from the joystick unit 18 to the main controller 101. According to the operation signal, the main controller 101 changes the propulsive force command and the steering angle command to be applied to the engine outboard motor OM and the electric outboard motor EM (Step S4). If the operation states of the engine outboard motor OM and the electric outboard motor EM are such that the hull 2 can thus achieve the rightward lateral movement behavior, the operator performs a decision operation (YES in Step S5). For example, the joystick button 181 may be pressed for the decision operation.

In response to the decision operation, the main controller 101 determines whether or not the joystick 8 is in the neutral position (Step S6). If the joystick 8 is not in the neutral position, a rightward lateral movement calibration value is written and set in the memory 101M (Step S7). The calibration value written in the memory 101M is used when the main controller 101 thereafter computes the propulsive force command and the steering angle command according to the operation of the joystick 8 for the watercraft maneuvering with the use of the joystick 8. Therefore, the rightward lateral movement calibration value is used for the computation of the propulsive force command and the steering angle command when the rightward lateral movement operation is performed on the joystick 8 in the joystick mode.

The calibration value includes the steering angle of the engine outboard motor OM, the steering angle of the electric outboard motor EM, and a thrust ratio (hereinafter referred to as "rightward lateral movement thrust ratio") each observed when the decision operation (Step S5) is performed. The thrust ratio is a ratio between the magnitude of a forward propulsive force generated by one of the two propulsion devices (forward thrust) and the magnitude of a reverse propulsive force generated by the other propulsion device (reverse thrust). That is, (Thrust ratio)=(Forward thrust)/(Reverse thrust). The rightward lateral movement thrust ratio is a thrust ratio observed when the rightward lateral movement is achieved (when the decision operation is performed) in the calibration mode.

The main controller 101 computes the rightward lateral movement thrust ratio based on the forward thrust (output command value) and the reverse thrust (output command value) observed when the decision operation (Step S5) is performed, and writes the rightward lateral movement thrust ratio in the memory 101M (Step S7).

Further, the main controller 101 determines whether or not a calibration state value is a value indicating "incompletion" (Step S8). If the calibration is completed, the main controller 101 sets the calibration state value to a value indicating "completion." If the calibration is not completed, the main controller 101 sets the calibration state value to the value indicating "incompletion."

If the calibration state value is "incompletion" (YES in Step S8), the main controller 101 computes the leftward lateral movement thrust ratio based on the rightward lateral movement thrust ratio, and overwrites the default value with the computed value in the memory 101M (Step S9). Specifically, the main controller 101 computes the inverse of the rightward lateral movement thrust ratio as the leftward lateral movement thrust ratio, and sets the computed leftward lateral movement thrust ratio in the memory 101M. When the leftward lateral movement calibration is thereafter performed, the leftward lateral movement thrust ratio thus set is used as an initial value. The leftward lateral movement thrust ratio is a ratio between a forward thrust and a reverse thrust to be used for the leftward lateral movement in the joystick mode.

Then, the main controller 101 changes the calibration state value to "completion" (Step S10), and switches its control mode to the joystick mode (Step S11). If the calibration state value is not "incompletion" in Step S8, i.e., if the calibration state value is "completion" (NO in Step S8), Steps S9 and S10 are skipped, and the control mode is switched to the joystick mode (Step S11).

If the joystick 8 is in the neutral position (YES in Step S6) when the decision operation (Step S5) is performed, the main controller 101 determines that the reset operation is performed to reset the calibration value to the default value. In this case, the main controller 101 resets the calibration value to the default value (Step S12), and sets the calibration state value to "incompletion" (Step S13). Thereafter, the control mode is switched to the joystick mode (Step S11).

The operator can start the leftward lateral movement calibration by performing the predetermined calibration start operation. If the calibration start operation is performed (YES in Step S1), the control mode of the main controller 101 is switched to the calibration mode (Step S2).

Upon the switching to the calibration mode, the main controller 101 reads out a calibration value from the memory 101M and, when the operator operates the joystick 8, the main controller 101 generates a propulsive force command and a steering angle command by using the calibration value (Step S3). If the leftward lateral movement calibration is performed after the rightward lateral movement calibration, the leftward lateral movement thrust ratio as the calibration value has been set to the inverse of the rightward lateral movement thrust ratio (see Step S9). This value is used as the initial value of the leftward lateral movement thrust ratio for the leftward lateral movement calibration.

The operator performs a leftward lateral movement operation, i.e., inclines the joystick 8 leftward, for the leftward lateral movement calibration. The operator observes the behavior of the hull 2. If the hull 2 is moved left-forward, the operator changes the inclination direction of the joystick 8 to a left rearward direction in order to correct the hull movement. If the hull 2 is moved left-rearward, the operator changes the inclination direction of the joystick 8 to a left forward direction in order to correct the hull movement. If the bow of the hull 2 is turned clockwise, the operator twists the joystick 8 counterclockwise in order to correct the bow turning. If the bow of the hull 2 is turned counterclockwise, the operator twists the joystick 8 clockwise in order to correct the bow turning.

According to the operation of the joystick 8, the operation signal of the joystick 8 is inputted from the joystick unit 18 to the main controller 101. According to the operation signal, the main controller 101 changes the propulsive force command and the steering angle command to be applied to the engine outboard motor OM and the electric outboard motor EM (Step S4). If the operation states of the engine outboard motor OM and the electric outboard motor EM are such that the hull 2 can thus achieve the leftward lateral movement behavior, the operator performs the decision operation (YES in Step S5).

In response to the decision operation, the main controller 101 determines whether or not the joystick 8 is in the neutral position (Step S6). If the joystick 8 is not in the neutral position, a leftward lateral movement calibration value is written and set in the memory 101M (Step S7). The leftward lateral movement calibration value is used for the computation of the propulsive force command and the steering angle command when the leftward lateral movement operation is thereafter performed on the joystick 8 in the joystick mode.

The leftward lateral movement calibration value includes the steering angle of the engine outboard motor OM, the steering angle of the electric outboard motor EM, and a thrust ratio (leftward lateral movement thrust ratio) each observed when the decision operation is performed. At this time, the leftward lateral movement thrust ratio is written in the memory 101M.

If the initial value of the leftward lateral movement thrust ratio is close to a true value (a true value observed when the hull 2 is laterally moved leftward), the leftward lateral movement calibration is quickly completed because the operator does not need to perform various operations for the correction of the hull behavior.

Where the leftward lateral movement calibration is performed after the rightward lateral movement calibration, the calibration state value is "completion" (YES in Step S8), so that the main controller 101 skips Steps S9 and S10 and switches its control mode to the joystick mode (Step S11).

The calibration can be performed again by performing the reset operation to reset the calibration value (YES in Step S6).

Figure 13:
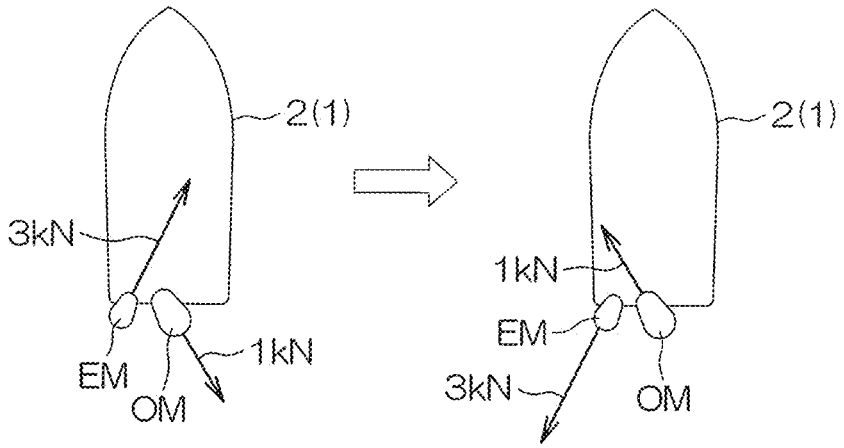
FIG. 13 is a diagram for describing an exemplary operation (inventive example) in which, after calibration for lateral movement in one of opposite lateral directions, a lateral movement thrust ratio is set in calibration for lateral movement in the other lateral direction.

FIG. 13 is a diagram for describing an exemplary operation (inventive example) in which, after calibration for lateral movement in one of opposite lateral directions, a lateral movement thrust ratio (the leftward lateral movement thrust ratio in the aforementioned example) is set in calibration for lateral movement in the other lateral direction.

During the rightward lateral movement, the electric outboard motor EM generates a forward thrust, and the engine outboard motor OM generates a reverse thrust. In this example, the forward thrust is 3 kN, and the reverse thrust is 1 kN. Therefore, the rightward lateral movement thrust ratio is 3 (=3 kN/1 kN). If the rightward lateral movement calibration value is determined in this state, the initial value of the leftward lateral movement thrust ratio is set to 0.33 (=⅓), which is the inverse of the rightward lateral movement thrust ratio. During the leftward lateral movement, the electric outboard motor EM generates a reverse thrust, and the engine outboard motor OM generates a forward thrust. Therefore, when the leftward lateral movement calibration is started, for example, the electric outboard motor EM generates a reverse thrust of 3 kN and the engine outboard motor OM generates a forward thrust of 1 kN based on the initial value of the leftward lateral movement thrust ratio.

Figure 14:
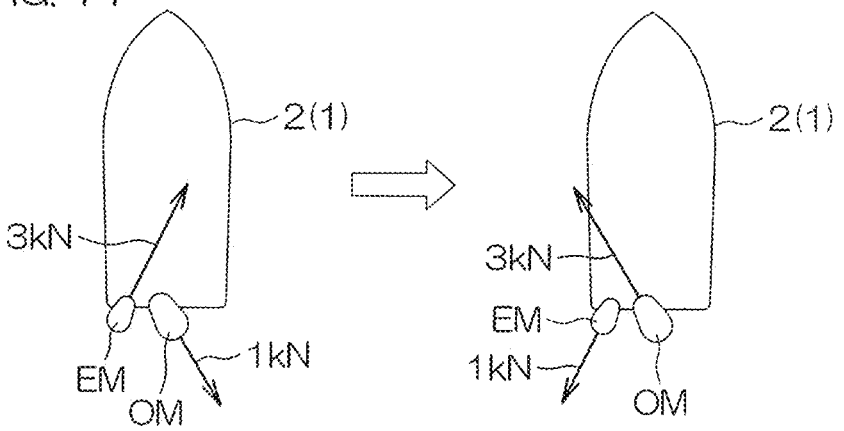
FIG. 14 is a diagram for describing another exemplary operation (comparative example) in which, after the calibration for the lateral movement in the one lateral direction, a lateral movement thrust ratio is set in the calibration for the lateral movement in the other lateral direction.

FIG. 14 is a diagram for describing another exemplary operation (comparative example) in which, after the calibration for the lateral movement in the one lateral direction, a lateral movement thrust ratio (the leftward lateral movement thrust ratio in the aforementioned example) is set in the calibration for the lateral movement in the other lateral direction.

As in the example of FIG. 13, it is assumed that the calibration value for the rightward lateral movement thrust ratio is set to 3 (=3 kN/1 kN) in the rightward lateral movement calibration. In the example of FIG. 14, the initial value of the leftward lateral movement thrust ratio is set to the same value as the calibration value for the rightward lateral movement thrust ratio, i.e., 3. During the leftward lateral movement, the electric outboard motor EM generates a reverse thrust, and the engine outboard motor OM generates a forward thrust. Therefore, when the leftward lateral movement calibration is started, for example, the electric outboard motor EM generates a reverse thrust of 1 kN, and the engine outboard motor OM generates a forward thrust of 3 kN. That is, the result of the rightward lateral movement calibration is mirrored to be set as the initial value for the leftward lateral movement calibration in the initial value setting operation of FIG. 14.

A comparison is made between the exemplary initial value setting operation shown in FIG. 13 and the exemplary initial value setting operation shown in FIG. 14. In the example of FIG. 13, the reverse thrust generated by the electric outboard motor EM is greater than the forward thrust generated by the engine outboard motor OM at the start of the leftward lateral movement calibration. In the example of FIG. 14, the reverse thrust generated by the electric outboard motor EM is smaller than the forward thrust generated by the engine outboard motor OM at the start of the leftward lateral movement calibration.

As described above, the engine outboard motor OM and the electric outboard motor EM are disposed asymmetrically with respect to the center line 2*a* of the hull 2. Therefore, even if the engine outboard motor OM and the electric outboard motor EM generate thrusts of the same magnitude, propulsive forces effectively applied to the hull 2 by the engine outboard motor OM and the electric outboard motor EM are different in magnitude. During the leftward lateral movement, particularly, the electric outboard motor EM is driven in reverse to discharge water jet forward from the rear side, so that the water jet interferes with the hull 2 to reduce the propulsive force. In addition, the engine outboard motor OM discharges engine exhaust gas into water rearward from the propeller shaft 29 (see FIG. 3), so that the exhaust gas is trapped by the propeller 60 of the electric outboard motor EM to further reduce the propulsive force.

Thus, the initial value for the leftward lateral movement calibration is closer to the true value in the exemplary initial value setting operation of FIG. 13 (inventive example) than in the exemplary initial value setting operation of FIG. 14 (comparative example). This facilitates the joystick operation (correction operation) to be performed by the operator in the leftward lateral movement calibration.

A relationship between the propulsive force of the engine outboard motor OM and the propulsive force of the electric outboard motor EM observed when the watercraft 1 is laterally moved in a properly calibrated state is closer to that in the example of FIG. 13 than that in the example of FIG. 14. That is, the magnitude relationship between the forward propulsive force and the reverse propulsive force respectively generated by the electric outboard motor EM and the engine outboard motor OM in the rightward lateral movement and the magnitude relationship between the forward propulsive force and the reverse propulsive force respectively generated by the engine outboard motor OM and the electric outboard motor EM in the leftward lateral movement are reversed from each other. This makes it possible to achieve a proper hull behavior for the lateral movement in either direction.

Figure 15:
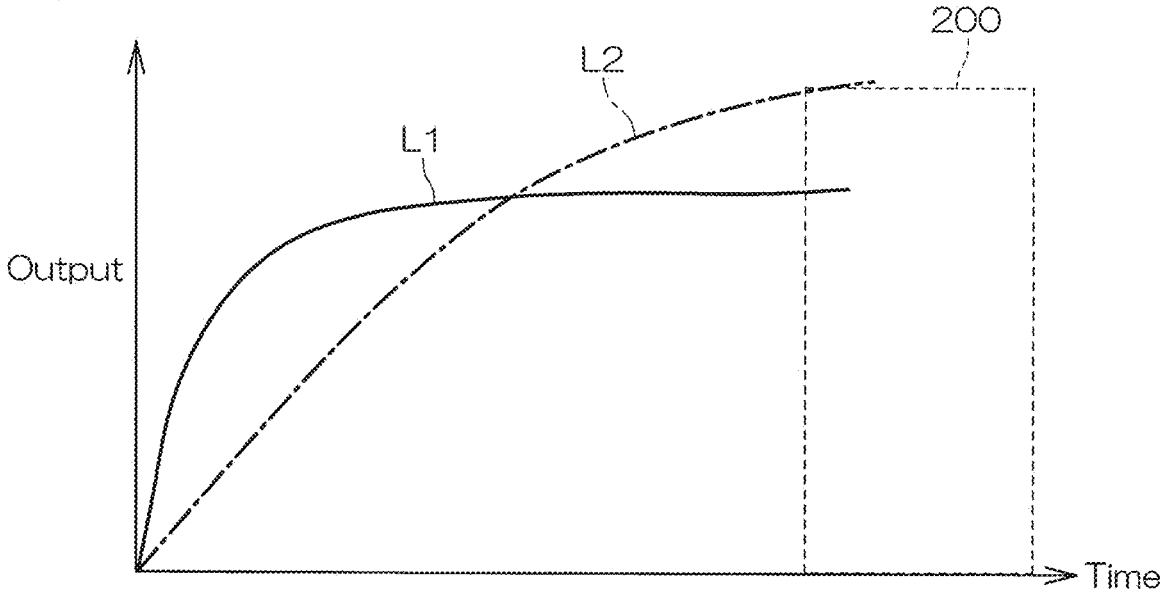
FIG. 15 is a characteristic diagram showing exemplary increasing characteristics of the propulsive forces of the electric outboard motor and the engine outboard motor.

FIG. 15 shows exemplary increasing characteristics of the propulsive forces of the electric outboard motor EM and the engine outboard motor OM, particularly showing changes in propulsive force with time when the propulsive force generation command is applied. The propulsive force of the electric outboard motor EM speedily increases upon the application of the command as shown by a line L1. In contrast, the propulsive force of the engine outboard motor OM increases relatively slowly as shown by a line L2. In the control mode utilizing both the engine outboard motor OM and the electric outboard motor EM, a stable hull behavior is provided in a time range 200 in which the propulsive forces of the engine outboard motor OM and the electric outboard motor EM are both plateaued. This is also true for the lateral movement.

However, the operator may perform the watercraft maneuvering operation for the lateral movement or the like in a time range in which the propulsive forces of the engine outboard motor OM and/or the electric outboard motor EM are on increasing edges. In this case, the operator can perform the calibration in such an increasing time range. That is, a lateral movement thrust ratio observed when a lateral movement behavior intended by the operator is achieved in the increasing time range is written as the calibration value in the memory 101M.

In this manner, the calibration is performed according to an operation method used by the operator.

While preferred embodiments of the present invention have thus been described, the present invention may be embodied in some other ways.

For example, the main propulsion device is not necessarily required to be the engine propulsion device adapted to be driven by the engine, but an electric propulsion device having a relatively high output may be used as the main propulsion device. Similarly, the auxiliary propulsion device is not necessarily required to be the electric propulsion device, but an engine propulsion device having a relatively low output may be used as the auxiliary propulsion device.

Further, the watercraft propulsion system may include two or more main propulsion devices. Similarly, the watercraft propulsion system may include two or more auxiliary propulsion devices.

The propulsion devices are not necessarily required to be attached to the stern 3, but an auxiliary propulsion device such as a trolling motor may be attached to the bow or other portion of the hull.

In a preferred embodiment described above, the outboard motors are used as the propulsion devices by way of example, but inboard motors, inboard/outboard motors (stern drives), waterjet propulsion devices and other types of propulsion devices may be employed.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft propulsion system comprising:

a first propulsion device attachable to a hull;

a second propulsion device attachable to the hull asymmetrically to the first propulsion device with respect to an anteroposterior center line of the hull;

a lateral movement command generator to generate a first lateral movement command to laterally move the hull in one of a rightward direction and a leftward direction, and to generate a second lateral movement command to laterally move the hull in the other of the rightward direction and the leftward direction; and a controller configured or programmed to perform a first lateral movement control in response to the first lateral movement command to cause one of the first propulsion device and the second propulsion device to generate a reverse propulsive force and cause the other of the first propulsion device and the second propulsion device to generate a forward propulsive force, and to perform a second lateral movement control in response to the second lateral movement command to cause the one of the first propulsion device and the second propulsion device to generate a forward propulsive force and cause the other of the first propulsion device and the second propulsion device to generate a reverse propulsive force; wherein the controller includes a memory to store a first lateral movement thrust ratio indicating a ratio between the forward propulsive force and the reverse propulsive force in the first lateral movement control and a second lateral movement thrust ratio indicating a ratio between the forward propulsive force and the reverse propulsive force in the second lateral movement control, and is configured or programmed to set the forward propulsive force and the reverse propulsive force to be generated in the first lateral movement control according to the first lateral movement thrust ratio stored in the memory, and to set the forward propulsive force and the reverse propulsive force to be generated in the second lateral movement control according to the second lateral movement thrust ratio stored in the memory;

the controller is configured or programmed to set the first lateral movement thrust ratio and the second lateral movement thrust ratio in a calibration mode and, when one of the first lateral movement thrust ratio and the second lateral movement thrust ratio is set in the calibration mode, to set an initial value of the other of the first lateral movement thrust ratio and the second lateral movement thrust ratio to an inverse of the one lateral movement thrust ratio.

2. The watercraft propulsion system according to claim 1, wherein the first propulsion device is an engine propulsion device, and the second propulsion device is an electric propulsion device.

3. The watercraft propulsion system according to claim 1, wherein the first propulsion device is located on the center line, and the second propulsion device is offset from the center line.

4. The watercraft propulsion system according to claim 3, wherein the first propulsion device and the second propulsion device are attachable to a stern of the hull.

5. The watercraft propulsion system according to claim 1, wherein the first propulsion device includes a propeller rotation axis lower than a keel of the hull; and the second propulsion device includes a propeller rotation axis higher than the keel of the hull.

6. A watercraft comprising:

a hull; and the watercraft propulsion system according to claim 1 attached to the hull.

7. A watercraft propulsion system comprising:

a first propulsion device attachable to a hull;

a second propulsion device attachable to the hull asymmetrically to the first propulsion device with respect to an anteroposterior center line of the hull;

a lateral movement command generator to generate a first lateral movement command to laterally move the hull in one of a rightward direction and a leftward direction, and to generate a second lateral movement command to laterally move the hull in the other of the rightward direction and the leftward direction; and a controller configured or programmed to perform a first lateral movement control in response to the first lateral movement command to cause one of the first propulsion device and the second propulsion device to generate a reverse propulsive force and cause the other of the first propulsion device and the second propulsion device to generate a forward propulsive force, and to perform a second lateral movement control in response to the second lateral movement command to cause the one of the first propulsion device and the second propulsion device to generate a forward propulsive force and cause the other of the first propulsion device and the second propulsion device to generate a reverse propulsive force; wherein a magnitude relationship between the forward propulsive force and the reverse propulsive force in the first lateral movement control and a magnitude relationship between the forward propulsive force and the reverse propulsive force in the second lateral movement control are reversed from each other.

8. A watercraft comprising:

a hull; and the watercraft propulsion system according to claim 7 attached to the hull.

* * * * *